US011101591B2

(12) United States Patent
Itou et al.

(10) Patent No.: US 11,101,591 B2
(45) Date of Patent: Aug. 24, 2021

(54) CONNECTOR HAVING A TERMINAL WITH CYLINDRICAL PORTION, A BASE INSULATOR HOLDING THE TERMINAL HAVING HOLDING HOLE, AND A FRONT INSULATOR ATTACHED TO THE BASE INSULATOR WITH PASSING HOLE IN FRONT OF HOLDING HOLE AND SMALLER THAN CYLINDRICAL PORTION

(71) Applicant: Japan Aviation Electronics Industry, Limited, Tokyo (JP)

(72) Inventors: Yasukazu Itou, Tokyo (JP); Katsuhiko Nakazawa, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 27 days.

(21) Appl. No.: 16/625,128

(22) PCT Filed: Apr. 27, 2018

(86) PCT No.: PCT/JP2018/017288
§ 371 (c)(1),
(2) Date: Dec. 20, 2019

(87) PCT Pub. No.: WO2019/012785
PCT Pub. Date: Jan. 17, 2019

(65) Prior Publication Data

US 2020/0153146 A1 May 14, 2020

(30) Foreign Application Priority Data

Jul. 14, 2017 (JP) ..... JP2017-137870

(51) Int. Cl.
*H01R 13/426* (2006.01)
*H01R 13/434* (2006.01)
(Continued)

(52) U.S. Cl.
CPC ..... *H01R 13/434* (2013.01); *H01R 13/426* (2013.01); *H01R 24/58* (2013.01); *H01R 2107/00* (2013.01)

(58) Field of Classification Search
CPC ..... H01R 13/426–436; H01R 13/4364
See application file for complete search history.

(56) References Cited

U.S. PATENT DOCUMENTS 4,975,082 A * 12/1990 Nagasaka ..... H01R 13/4365 439/594
5,181,860 A 1/1993 Homma et al.
(Continued)

FOREIGN PATENT DOCUMENTS

EP 0 344 691 A2 12/1989
JP H04-023076 U 2/1992
(Continued)

OTHER PUBLICATIONS

Extended European Search Report in EP 18832698.7, dated May 8, 2020.
(Continued)

*Primary Examiner* — Edwin A. Leon
*Assistant Examiner* — Milagros Jeancharles
(74) *Attorney, Agent, or Firm* — Collard & Roe, P.C.

(57) ABSTRACT

A connector (10) has: a terminal (20); a base insulator (30) having a holding hole (330); and a front insulator (40) having a passage hole (430). The terminal (20) has: a cylindrical section (22); a lance (26) extending from the cylindrical section (22); and a stopper (270) projecting from the cylindrical section (22). The terminal (20) is retained by the holding hole (330). A retaining portion (334) inside the holding hole (330) is positioned between the lance (260) of the terminal (20) and the stopper (270). A gap is formed between an inner wall (332) of the holding hole (330) and
(Continued)

the cylindrical section (22) of the terminal (20). The front insulator (40) is attached to the base insulator (30). The passage hole (430) is positioned in front of the holding hole (330). The passage hole (430) is smaller than the cylindrical section (22) of the terminal (20).

9 Claims, 22 Drawing Sheets

(51) Int. Cl.
*H01R 24/58* (2011.01)
*H01R 107/00* (2006.01)

(56) References Cited

U.S. PATENT DOCUMENTS 5,240,424 A 8/1993 Honma et al.
5,458,496 A 10/1995 Itou et al.
5,556,284 A 9/1996 Itou et al.
5,577,920 A 11/1996 Itou et al.
5,816,643 A 10/1998 Itou et al.
9,368,930 B2 * 6/2016 Smith ..... H01R 13/516

FOREIGN PATENT DOCUMENTS

JP H04-102167 U 9/1992
JP H07-094240 A 4/1995
JP 2005-302398 A 10/2005
JP 2010-049866 A 3/2010
JP 2010-257863 A 11/2010

OTHER PUBLICATIONS

International Search Report in PCT/JP2018/017288, dated Jul. 17, 2018.
Japanese Office Action in JP 2017-137870, dated Jun. 20, 2019.
Chinese Office Action dated Jul. 30, 2020 in Chinese Application No. 201880044095.3, with English translation.
Chinese Office Action dated Mar. 10, 2021 in Chinese Application No. 201880044095.3, with English translation.

* cited by examiner

CONNECTOR HAVING A TERMINAL WITH CYLINDRICAL PORTION, A BASE INSULATOR HOLDING THE TERMINAL HAVING HOLDING HOLE, AND A FRONT INSULATOR ATTACHED TO THE BASE INSULATOR WITH PASSING HOLE IN FRONT OF HOLDING HOLE AND SMALLER THAN CYLINDRICAL PORTION

CROSS REFERENCE TO RELATED APPLICATIONS

This application is the National Stage of PCT/JP2018/017288 filed on Apr. 27, 2018, which claims priority under 35 U.S.C. § 119 of Japanese Application No. 2017-137870 filed on Jul. 14, 2017, the disclosure of which is incorporated by reference. The international application under PCT article 21(2) was not published in English.

TECHNICAL FIELD

This invention relates to a connector comprising a terminal, a base insulator holding the terminal and a front insulator attached to the base insulator for electric shock prevention.

BACKGROUND ART

For example, this type of connector is disclosed in Patent Document 1.

Referring to FIG. 29, Patent Document 1 discloses a connector 90 comprising a shell 92, a first insert (base insulator) 96, a cover insert (front insulator) 98 and a plurality of contacts (not-illustrated terminals). Referring to FIG. 30, the base insulator 96 is formed with two lock grooves 962 and a plurality of insertion holes 968. The front insulator 98 is formed with two lock portions 982 and a plurality of insertion holes 988. Referring to FIGS. 29 and 30, the front insulator 98 is attached to the base insulator 96 from the front so that the lock portions 982 are engaged with the lock grooves 962, respectively. The thus-attached front insulator 98 forms a structure 94 together with the base insulator 96. The structure 94 is inserted into the shell 92 from behind to be held therein, so that the connector 90 is formed.

In the connector 90, the terminals (not shown) are inserted into the insertion holes 968 of the base insulator 96 from behind, respectively, and are held by using lances (not shown). The insertion holes 988 of the front insulator 98 are located in front of the insertion holes 968 of the base insulator 96, respectively. The front end of each of the terminals is located at a rear end part of the corresponding insertion hole 988. For example, even if a finger is inserted into the insertion hole 988, the finger does not reach the front end of the terminal. Thus, the front insulator 98 prevents electric shock which might be caused by contact with the terminal.

PRIOR ART DOCUMENTS

Patent Document(s)

Patent Document 1: JP A 2010-257863

SUMMARY OF INVENTION

Technical Problem

In general, when a connector is assembled, a terminal once inserted into and held by a holding hole of a holding member such as a base insulator sometimes needs to be replaced or to be swapped for a terminal held in another holding hole. However, such replacement and swapping between terminals are not considered for the existing connector.

It is therefore an object of the present invention to provide a connector which allows easy replacement of a terminal in the assembly of the connector while having an electric shock prevention function.

Solution to Problem

An aspect of the present invention provides a connector connectable to a cable. The connector comprises a plurality of terminals, a base insulator and a front insulator. Each of the terminals has a cylindrical portion, a lance, a stopper and a connection portion. The cylindrical portion has a cylindrical shape extending along a front-rear direction. The lance extends rearward in the front-rear direction from the cylindrical portion while extending outward in a radial direction perpendicular to the front-rear direction. The stopper projects outward in the radial direction from the cylindrical portion and is apart from the lance in the front-rear direction to be located rearward of the lance. The connection portion is a part connected to the cable when the connector is used and is located rearward of the stopper in the front-rear direction. The base insulator is formed with a plurality of holding holes corresponding to the terminals, respectively. Each of the terminals is held in a corresponding one of the holding holes. Each of the holding holes is formed with a gap which is located between an inner wall thereof and the cylindrical portion of a corresponding one of the terminals in a perpendicular plane perpendicular to the front-rear direction. Each of the holding holes is provided with a retaining portion located therewithin. For each of the holding holes, the retaining portion is located between the lance and the stopper of the terminal in the front-rear direction. The front insulator is formed with a plurality of passing holes corresponding to the terminals, respectively. The front insulator is attached to the base insulator. The passing holes are located in front of the holding holes in the front-rear direction, respectively. Each of the passing holes is smaller than the cylindrical portion of the corresponding one of the terminals in the perpendicular plane.

Advantageous Effects of Invention

In the connector of the present invention, the passing hole of the front insulator has a size smaller than that of the cylindrical portion of the terminal and is located in front of the holding hole of the base insulator in which the terminal is held. This structure prevents electrical shock which might be caused by contact with the terminal. Thus, the connector according to the present invention has an electric shock prevention function.

In the connector of the present invention, the retaining portion of the holding hole is located rearward of the lance of the terminal. If the terminal is forced to be removed rearward, the retaining portion catches the lance to prevent the terminal from coming off the holding hole. Moreover, the holding hole is formed with the gap which is located between the inner wall thereof and the cylindrical portion. This structure allows a jig to be inserted into the aforementioned gap to release the retention of the lance by the retaining portion under a state where the front insulator is not attached to the base insulator. Thus, the connector according to the present invention allows easy replacement of the terminal in the assembly of the connector.

An appreciation of the objectives of the present invention and a more complete understanding of its structure may be had by studying the following description of the preferred embodiment and by referring to the accompanying drawings.

DESCRIPTION OF EMBODIMENTS

Figure 1:
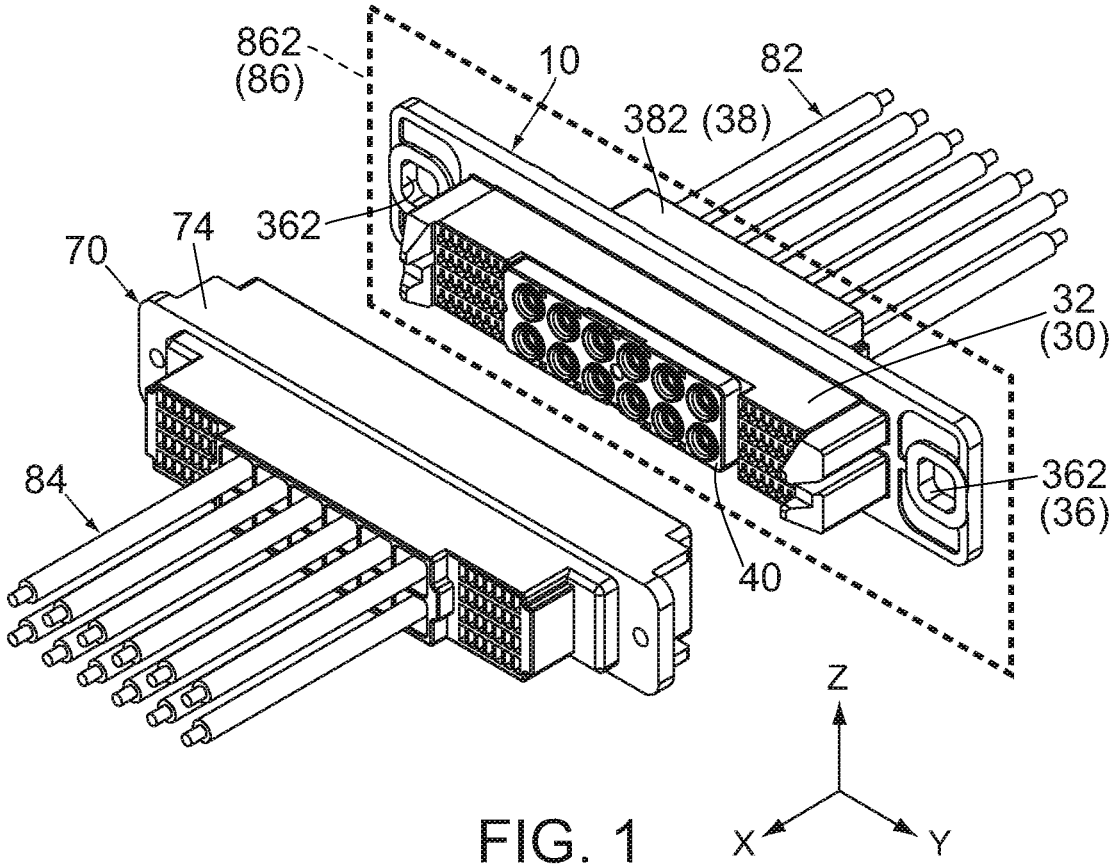
FIG. 1 is a perspective view showing a connector and a mating connector according to an embodiment of the present invention, wherein the connector is connected to cables and is separated from the mating connector connected to mating cables, and an outline of a part of a panel to which the connector is to be fixed is illustrated with dashed line.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

Figure 2:
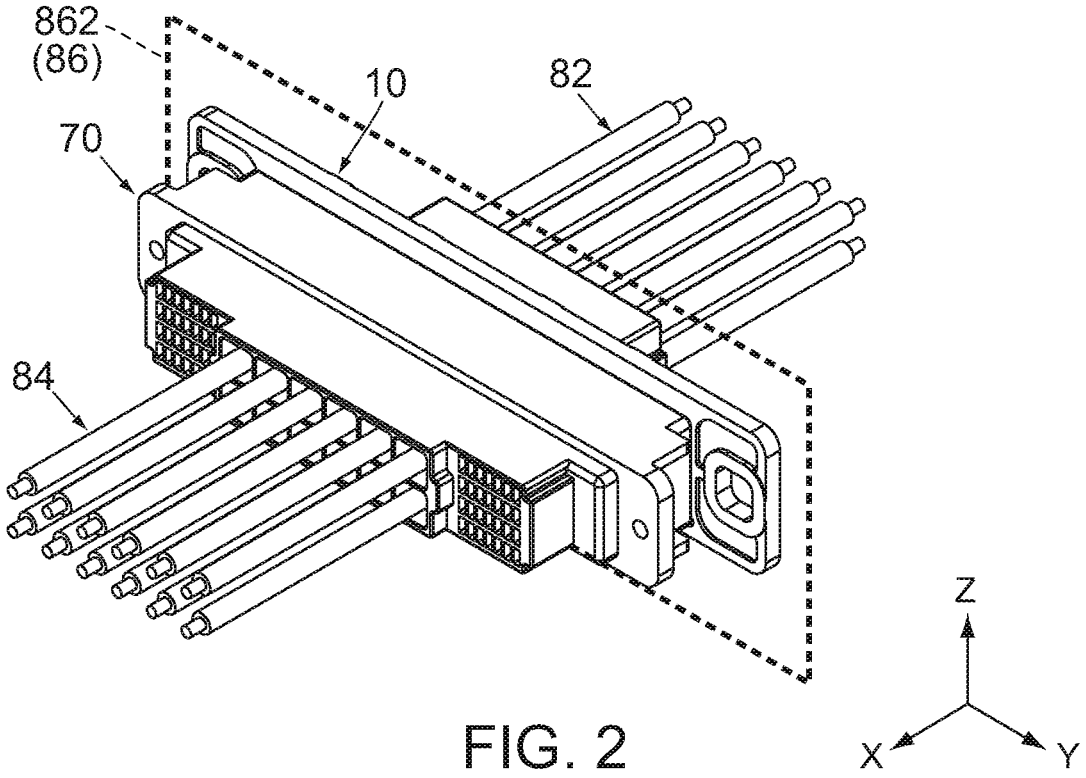
FIG. 2 is a perspective view showing the connector and the mating connector of FIG. 1, wherein the connector is mated with the mating connector, and an outline of a part of the panel is illustrated with dashed line.

Referring to FIGS. 1 and 2, a connector 10 according to an embodiment of the present invention is connectable to cables 82. The connector 10 is mateable with and removable from a mating connector 70, which is connected to mating cables 84, along a front-rear direction (mating direction: X-direction).

Figure 3:
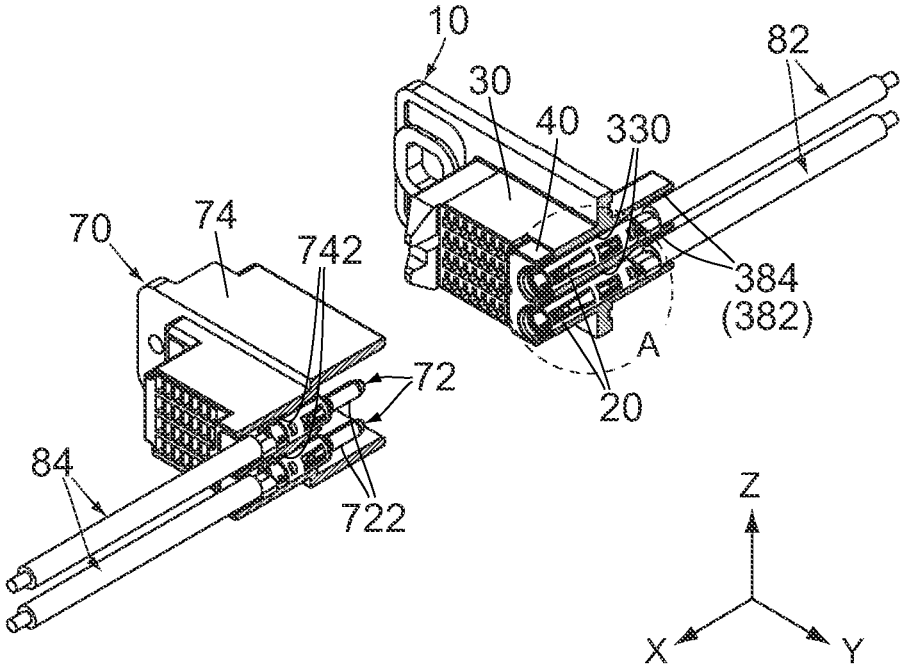
FIG. 3 is a partially cut-away, perspective view showing the connector and the mating connector of FIG. 1.

Referring to FIG. 3, the connector 10 comprises a plurality of terminals 20 each made of a conductor, a base insulator 30 made of an insulator and a front insulator 40 made of an insulator. The terminals 20 correspond to the cables 82, respectively, and have shapes and sizes the same as one another. The terminals 20 are held by the base insulator 30. The front insulator 40 is attached to the base insulator 30.

The mating connector 70 comprises a plurality of mating terminals 72 each made of a conductor and a mating housing 74 made of an insulator. The mating terminals 72 correspond to the mating cables 84, respectively, and have shapes and sizes the same as one another. Each of the mating terminals 72 is connected to the corresponding mating cable 84 at a positive X-side end thereof.

Figure 26:
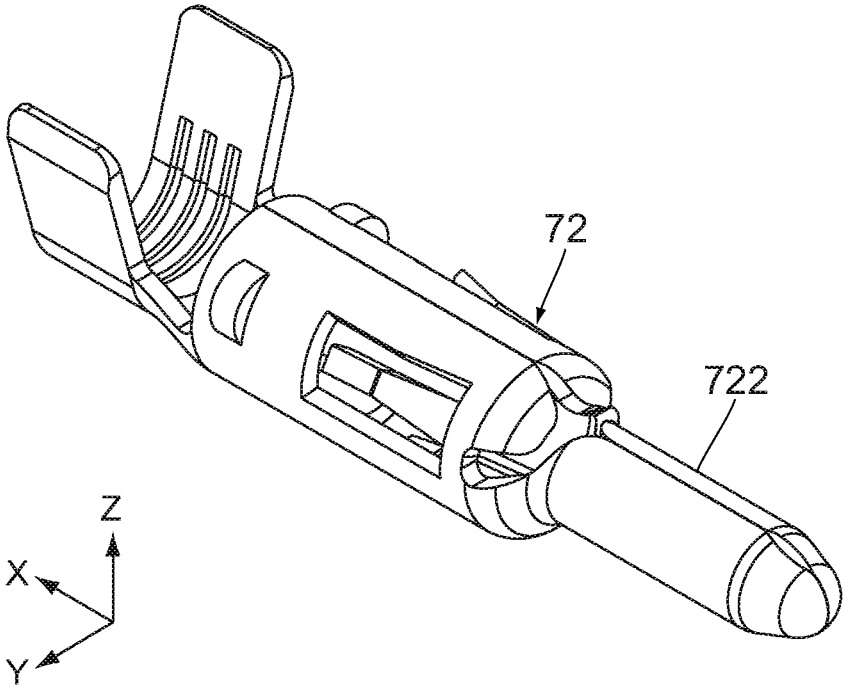
FIG. 26 is a perspective view showing a mating terminal of the mating connector of FIG. 1.
Figure 27:
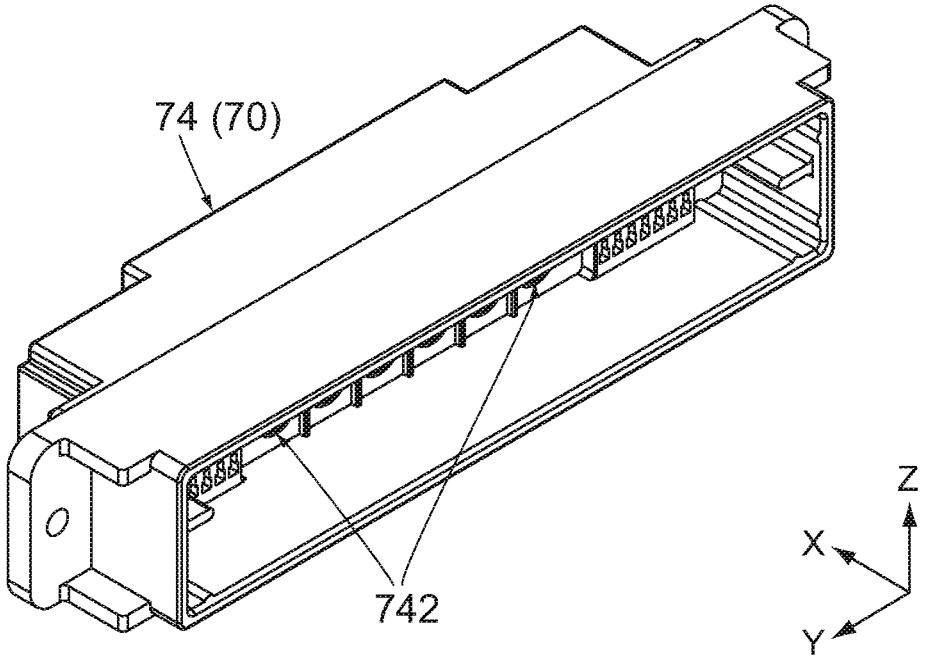
FIG. 27 is a perspective view showing a mating housing of the mating connector of FIG. 1.
Figure 28:
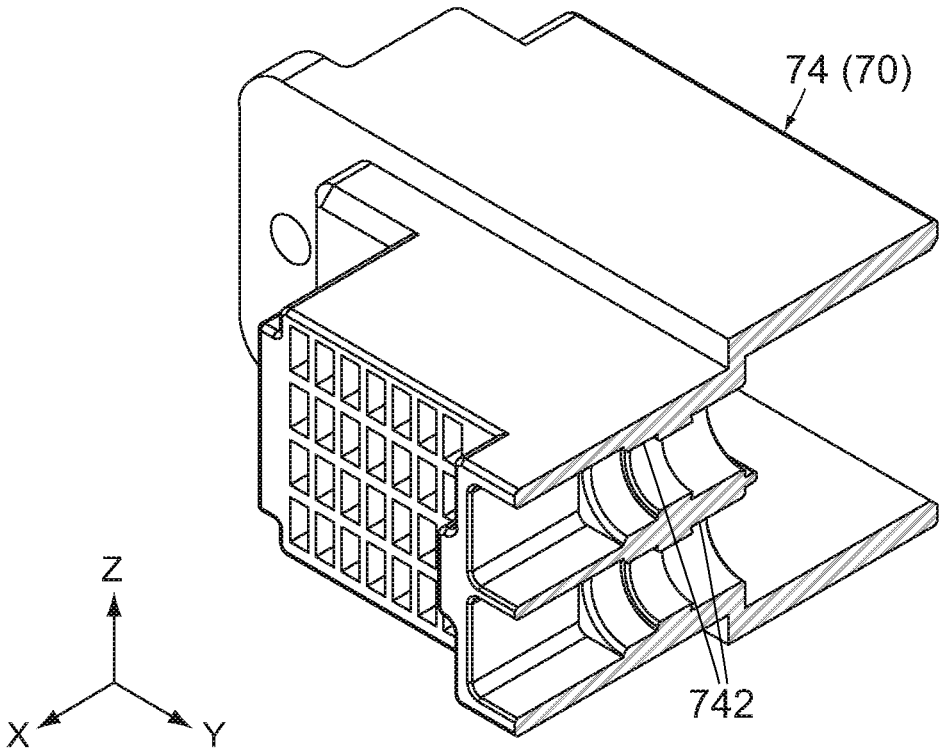
FIG. 28 is a partially cut-away, perspective view showing the mating housing of FIG. 27.
Figure 29:
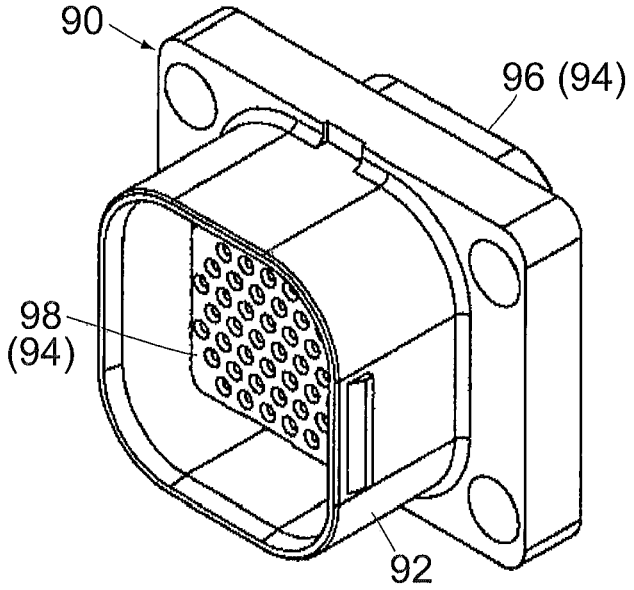
FIG. 29 PRIOR ART
FIG. 29 is a perspective view showing a connector of Patent Document 1.
Figure 30:
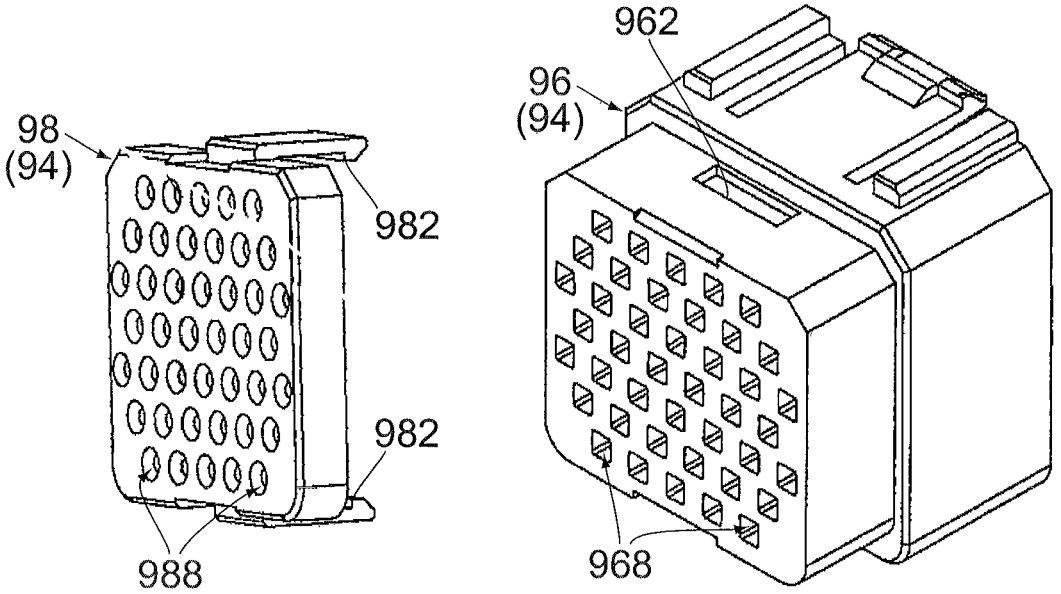
FIG. 30 PRIOR ART
FIG. 30 is an exploded, perspective view showing a structure included in the connector of FIG. 29.

As shown in FIGS. 3 and 26, each of the mating terminals 72 has a mating contact portion 722. Referring to FIGS. 3, 27 and 28, the mating housing 74 is formed with a plurality of mating holding holes 742 which correspond to the mating terminals 72, respectively. The mating holding holes 742 pass through the mating housing 74 in the front-rear direction (X-direction). Referring to FIG. 3, each of the mating terminals 72 is held in the corresponding mating holding hole 742. The mating contact portion 722 of each of the mating terminals 72 projects in the negative X-direction from the corresponding mating holding hole 742.

Figure 4:
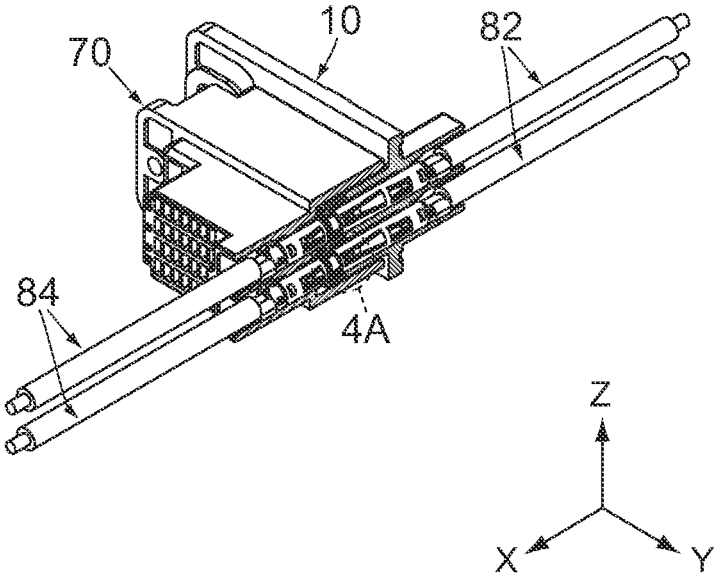
FIG. 4 is a partially cut-away, perspective view showing the connector and the mating connector of FIG. 2.
Figure 4A:
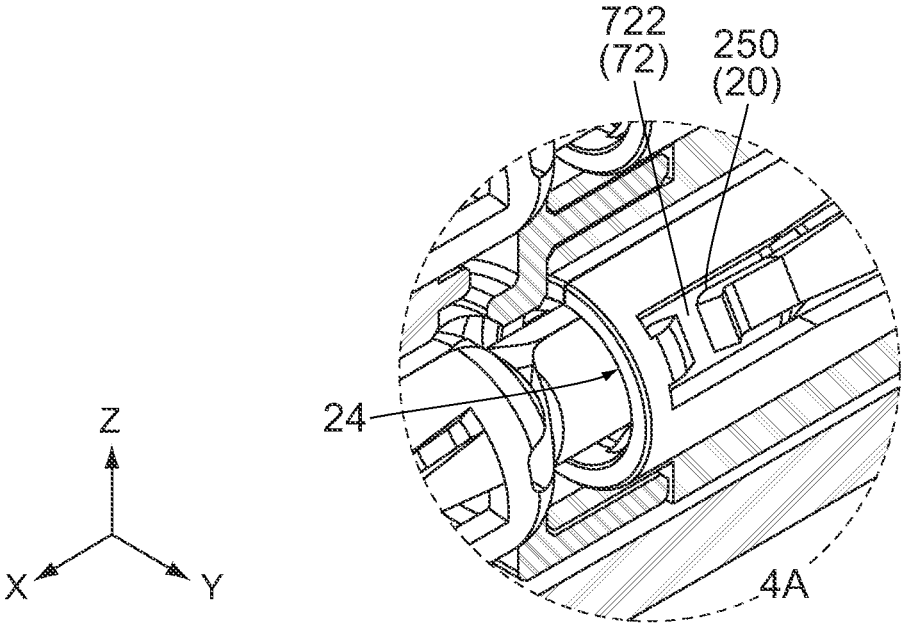
FIG. 4A is an enlarged, perspective view of detail 4A in FIG. 4 showing a connection part between the connector and the mating connector.

Referring to FIGS. 2, 4 and 4A, the terminals 20 correspond to the mating terminals 72, respectively. Under a mated state where the connector 10 and the mating connector 70 are mated with each other, each of the terminals 20 is brought into contact with the mating contact portion 722 of the corresponding mating terminal 72, so that the connector 10 and the mating connector 70 are electrically connected with each other.

Referring to FIGS. 1 and 2, in the present embodiment, the connector 10 is attached to a panel 862 of a case 86. The case 86 accommodates a power supply device (not shown) therewithin. The cables 82 connect the connector 10 and the power supply device with each other. The mating connector 70 is connected with a mating device (not shown) via the mating cables 84. Under the mated state, the power supply device supplies electric power to the mating device via the connector 10 and the mating connector 70. However the present invention is not limited thereto but is applicable to the connector 10 and the mating connector 70 of various usage.

Referring to FIGS. 1 and 3, the connector 10 of the present embodiment comprises twelve of the terminals 20. The terminals 20 are grouped into six pairs and are used for electric power transmission. However the present invention is not limited thereto, but the connector 10 should comprise a required number of the terminals 20 depending on its usage.

Hereafter, explanation will be made about the structure of each of the terminals 20.

Figure 11:
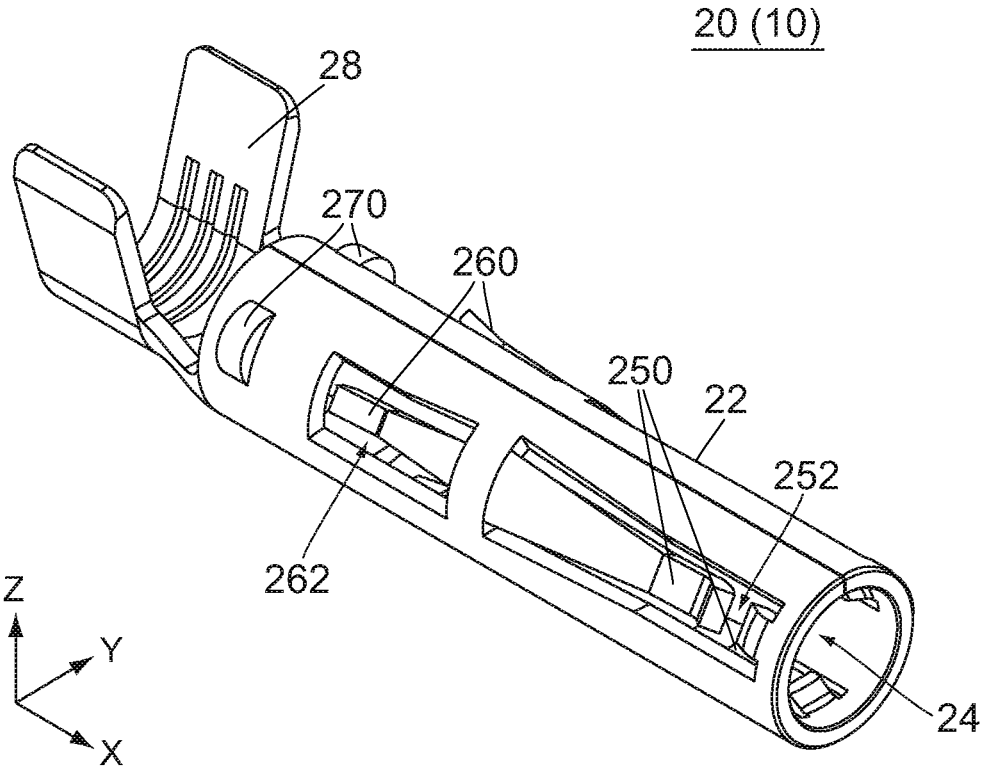
FIG. 11 is a perspective view showing a terminal of the connector of FIG. 6, wherein a connection portion of the terminal is not crimped.

Referring to FIG. 11, each of the terminals 20 has a cylindrical portion 22, a plurality of contact portions 250, a plurality of lances 260, a plurality of stoppers 270 and a connection portion 28. The terminal 20 according to the present embodiment is a single metal plate formed with various bends and holes. Thus, each portion of the terminal 20, i.e. each of the cylindrical portion 22, the contact portions 250, the lances 260, the stoppers 270 and the connection portion 28, is a part of the unitary terminal 20. However the present invention is not limited thereto. For example, the terminal 20 may be formed of a plurality of joined metal plates. Moreover, each portion of the terminal 20 is not limited to that described below but can be formed into various shapes.

Figure 12:
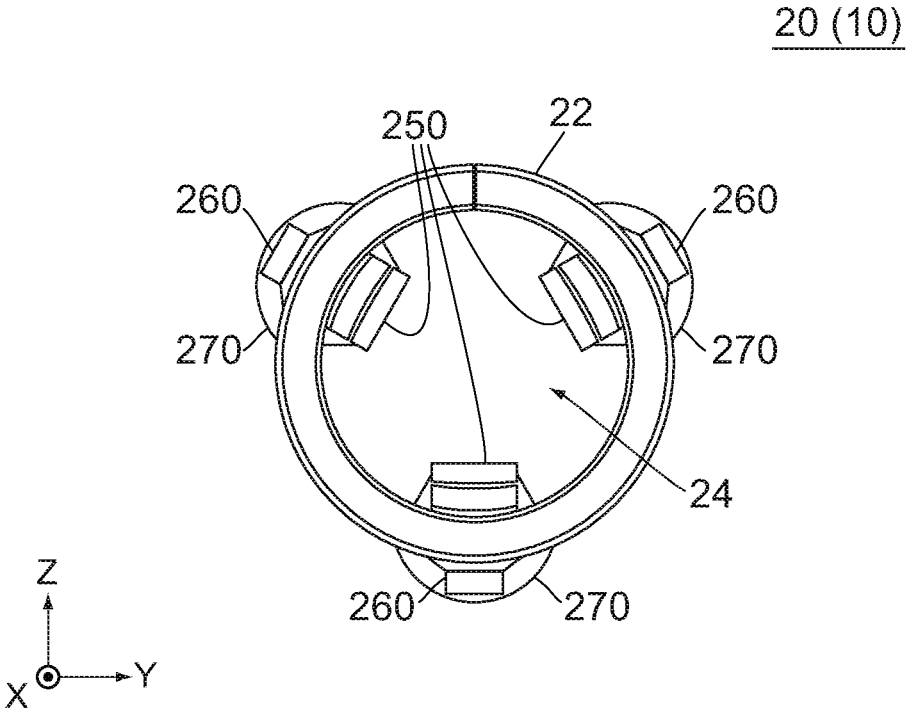
FIG. 12 is a front view showing the terminal of FIG. 11, wherein the connection portion of the terminal is not illustrated.

Referring to FIGS. 11 and 12, the cylindrical portion 22 has a cylindrical shape extending along the front-rear direction (X-direction). The cylindrical portion 22 has a receiving hole 24. The receiving hole 24 is a space enclosed by the cylindrical portion 22. The cylindrical portion 22 encloses the receiving hole 24 in a perpendicular plane (YZ-plane) perpendicular to the X-direction. The receiving hole 24 opens forward and rearward in the X-direction, or opens in the negative X-direction and in the positive X-direction.

Referring to FIG. 11, the cylindrical portion 22 is formed with a plurality of front holes 252 which correspond to the contact portions 250, respectively. Each of the contact portions 250 extends forward in the front-rear direction (X-direction) from an inner wall of a rear end, or a negative X-side end, of the corresponding front hole 252 while extending inward in a radial direction perpendicular to the X-direction. Each of the contact portions 250 is resiliently deformable. The contact portion 250 has a front end, or a positive X-side end, located in the receiving hole 24 (see FIG. 12). The front end of the contact portion 250 is movable in the radial direction in accordance with resilient deformation of the contact portion 250. Referring to FIGS. 4 and 4A, under the mated state, the mating contact portion 722 of the mating terminal 72 is inserted into the receiving hole 24 of the terminal 20. Meanwhile, the front end of the contact portion 250 of the terminal 20 is brought into contact with the mating contact portion 722 while being moved outward in the radial direction.

Referring to FIG. 11, the cylindrical portion 22 is formed with a plurality of rear holes 262 which correspond to the lances 260, respectively. Each of the lances 260 extends rearward in the front-rear direction (X-direction) from an inner wall of a front end of the corresponding rear hole 262 while extending outward in the radial direction. Thus, each of the lances 260 extends obliquely rearward so as to be away from the cylindrical portion 22. Each of the lances 260 is resiliently deformable. The lance 260 has a rear end located outside the cylindrical portion 22. The rear end of the lance 260 is movable in the radial direction in accordance with resilient deformation of the lance 260. The resilient deformation of the lance 260 enables the rear end of the lance 260 to be located in the rear hole 262 or in the receiving hole 24.

Referring to FIGS. 11 and 12, the stoppers 270 are projections provided on the cylindrical portion 22 and correspond to the lances 260, respectively. Each of the stoppers 270 has a front surface and a rear surface each perpendicular to the front-rear direction (X-direction). Each of the stoppers 270 projects outward in the radial direction from the cylindrical portion 22 and is apart from the rear end of the corresponding lance 260 in the X-direction to be located rearward of the corresponding lance 260.

Figure 5:
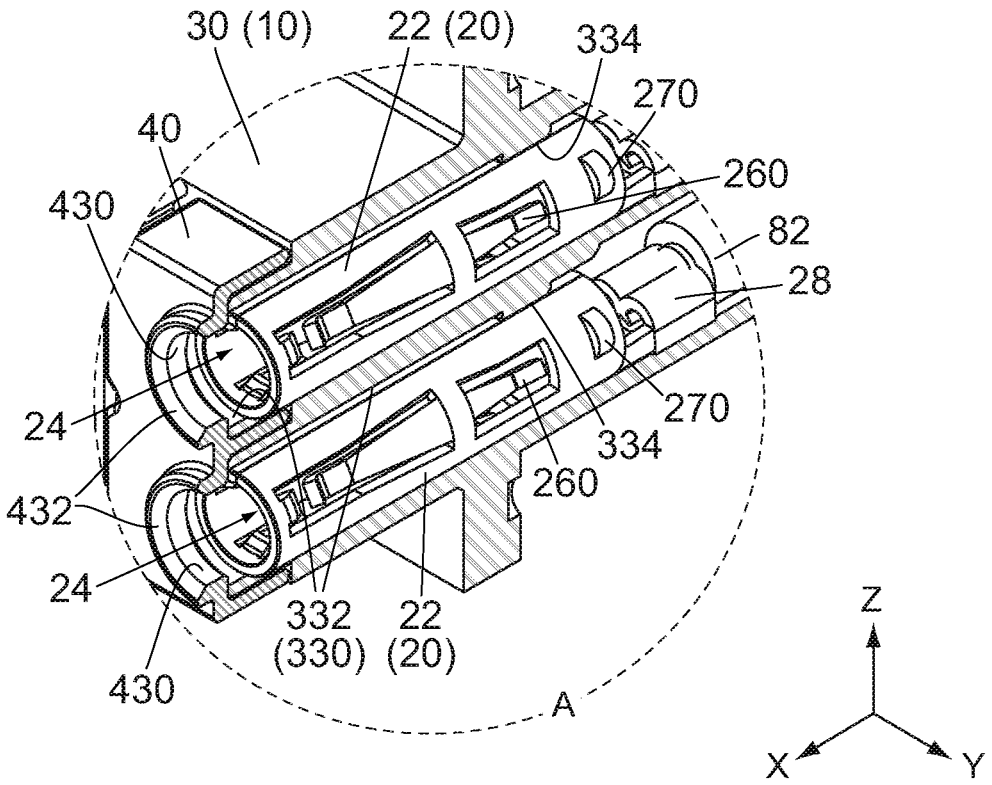
FIG. 5 is an enlarged, perspective view showing a part of the connector enclosed by dashed line A of FIG. 3.

Referring to FIGS. 5 and 11, the connection portion 28 is crimped around a core wire of the cable 82 to be connected to the cable 82 when the connector 10 is used. As shown in FIG. 11, the connection portion 28 is connected to a rear end of the cylindrical portion 22 in the front-rear direction (X-direction). Thus, the connection portion 28 is located rearward of the stoppers 270 in the X-direction.

Hereafter, explanation will be made about rough structures of the base insulator 30 and the front insulator 40.

Figure 13:
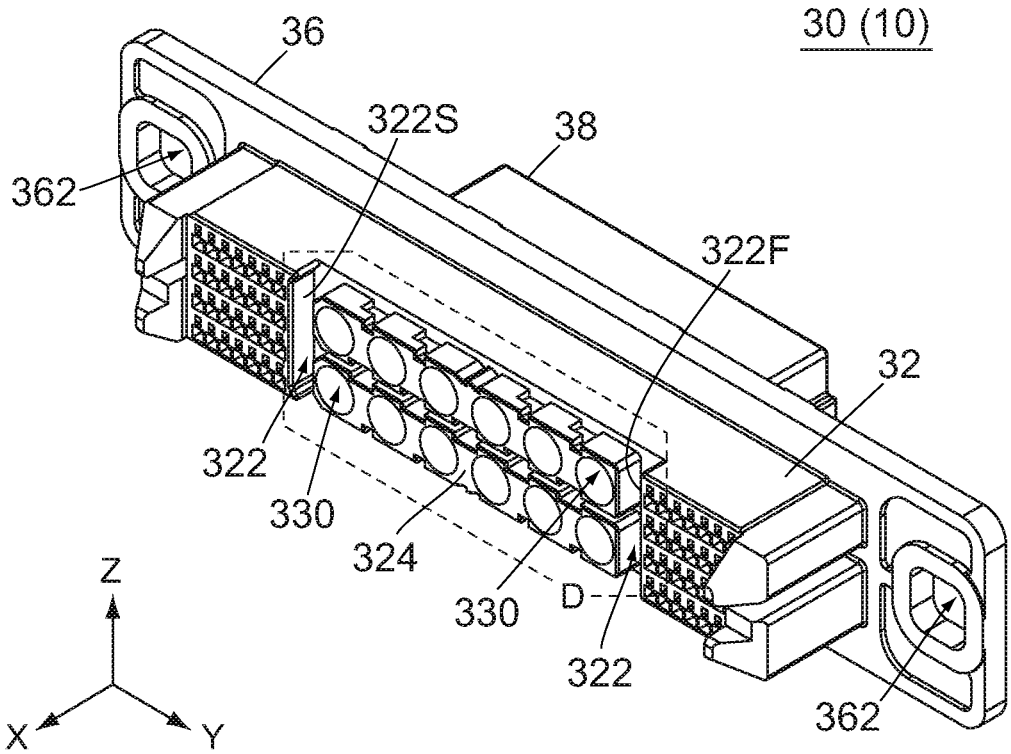
FIG. 13 is a perspective view showing a base insulator of the connector of FIG. 6.
Figure 16:
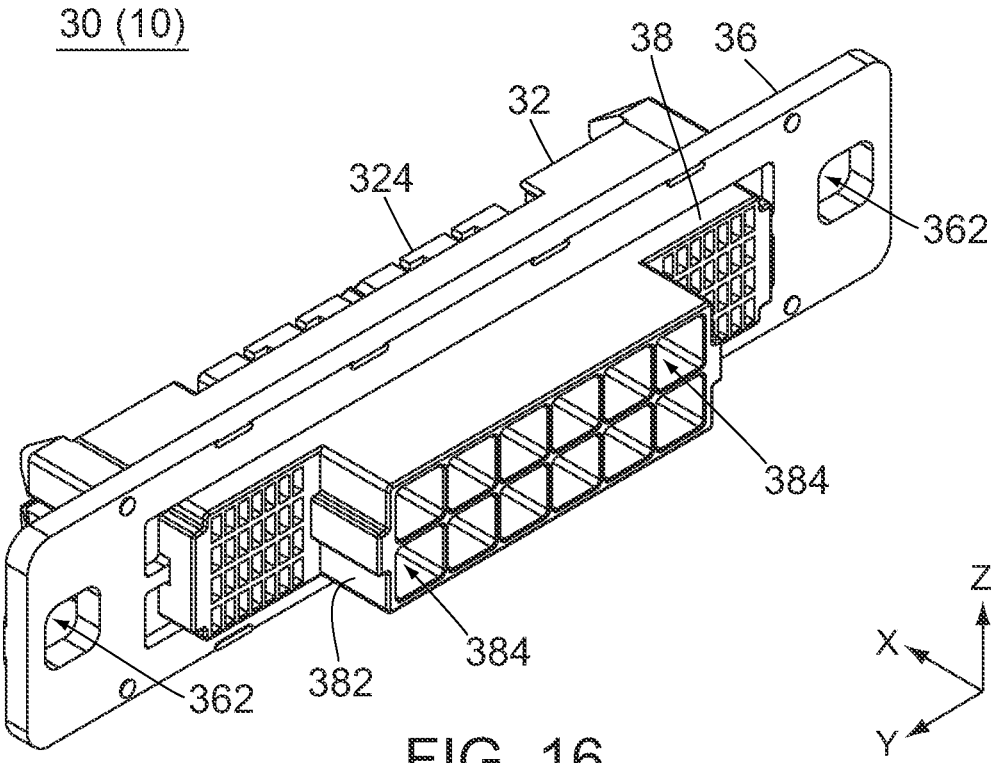
FIG. 16 is another perspective view showing the base insulator of FIG. 13.

As shown in FIGS. 13 and 16, the base insulator 30 of the present embodiment has a front portion 32, a flange 36 and a rear portion 38. The flange 36 has a flat-plate shape as a whole and extends in parallel to the perpendicular plane (YZ-plane). The front portion 32 projects forward from a part of the flange 36 located at the middle thereof in the YZ-plane. The rear portion 38 projects rearward from a part of the flange 36 located at the middle thereof in the YZ-plane. However, the structure of the base insulator 30 is not limited thereto but can be variously modified.

As shown in FIGS. 1, 13 and 16, the base insulator 30 has two fixed portions 362. The fixed portions 362 are holes which are formed in opposite sides of the flange 36, respectively, in a perpendicular direction (Y-direction) perpendicular to the front-rear direction (X-direction). Each of the fixed portions 362 passes through the flange 36 in the X-direction.

Referring to FIG. 1, the base insulator 30 of the present embodiment is fixed to the panel 862 of the case 86 at the fixed portions 362 when the connector 10 is used. For example, the connector 10 is fixed to the panel 862 by using fixing members (not shown) such as bolts passing through the fixed portions 362. When the base insulator 30 is fixed to the panel 862, the rear portion 38 of the base insulator 30 is located inside the case 86, while the front portion 32 and the flange 36 of the base insulator 30 and the front insulator 40 are located outside the case 86. However the present invention is not limited thereto. For example, the fixed portions 362 may be provided according to the usage of the connector 10.

Referring to FIG. 16, the rear portion 38 of the base insulator 30 has a cable-receiving portion 382. The cable-receiving portion 382 projects rearward from a part of the rear portion 38 located at the middle thereof in the perpendicular direction (Y-direction). Referring to FIGS. 3 and 16, the cable-receiving portion 382 is formed with a plurality of cable-receiving holes 384 which correspond to the cables 82, respectively.

Referring to FIGS. 13, 14, 17 and 17A, the front portion 32 of the base insulator 30 is formed with two side grooves 322. Each of the side grooves 322 is a recess recessed rearward. Each of the side grooves 322 extends along an upper-lower direction (Z-direction) perpendicular to both the front-rear direction (X-direction) and the perpendicular direction (Y-direction) and opens upward and downward. The side grooves 322 are apart from each other in the Y-direction. The positive Y-side side groove 322 is formed with a first surface 322F that is an inner wall surface of the recess, and the negative Y-side side groove 322 is formed with a second surface 322S that is an inner wall surface of the other recess.

Referring to FIG. 13, the front portion 32 of the base insulator 30 has an attachment portion 324. The attachment portion 324 is located at the middle of the front portion 32 in the perpendicular direction (Y-direction). The attachment portion 324 is located between the two side grooves 322 in the Y-direction and projects forward from the side grooves 322.

Figure 20:
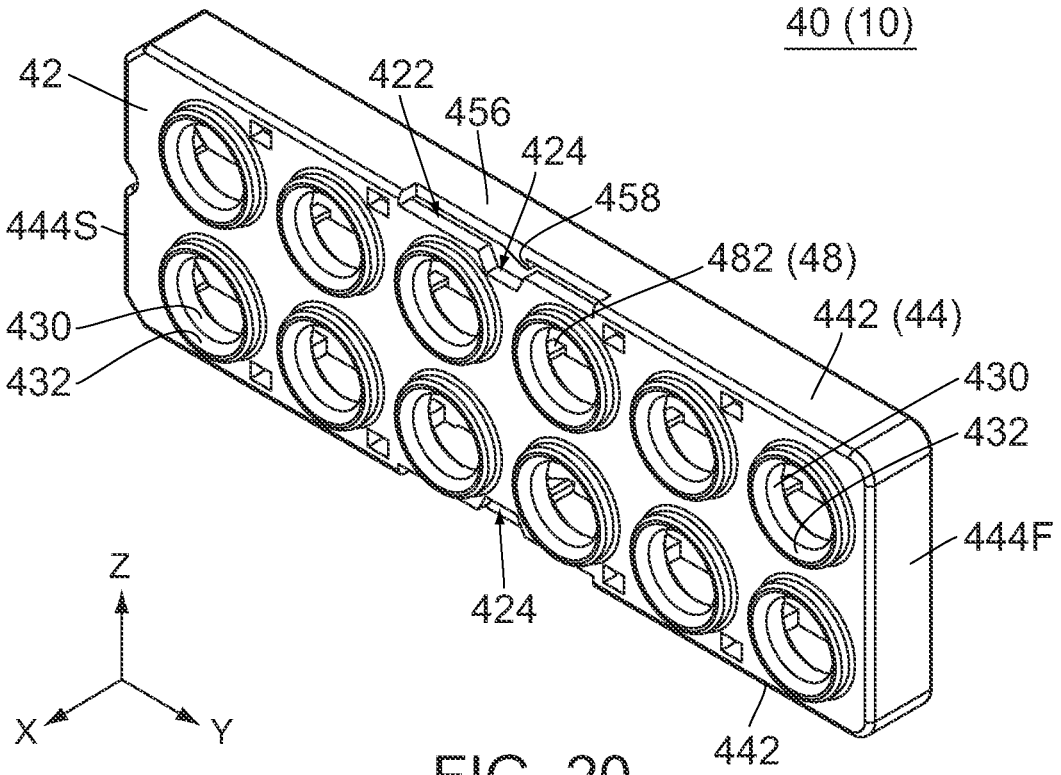
FIG. 20 is a perspective view showing the front insulator of the connector of FIG. 6.
Figure 21:
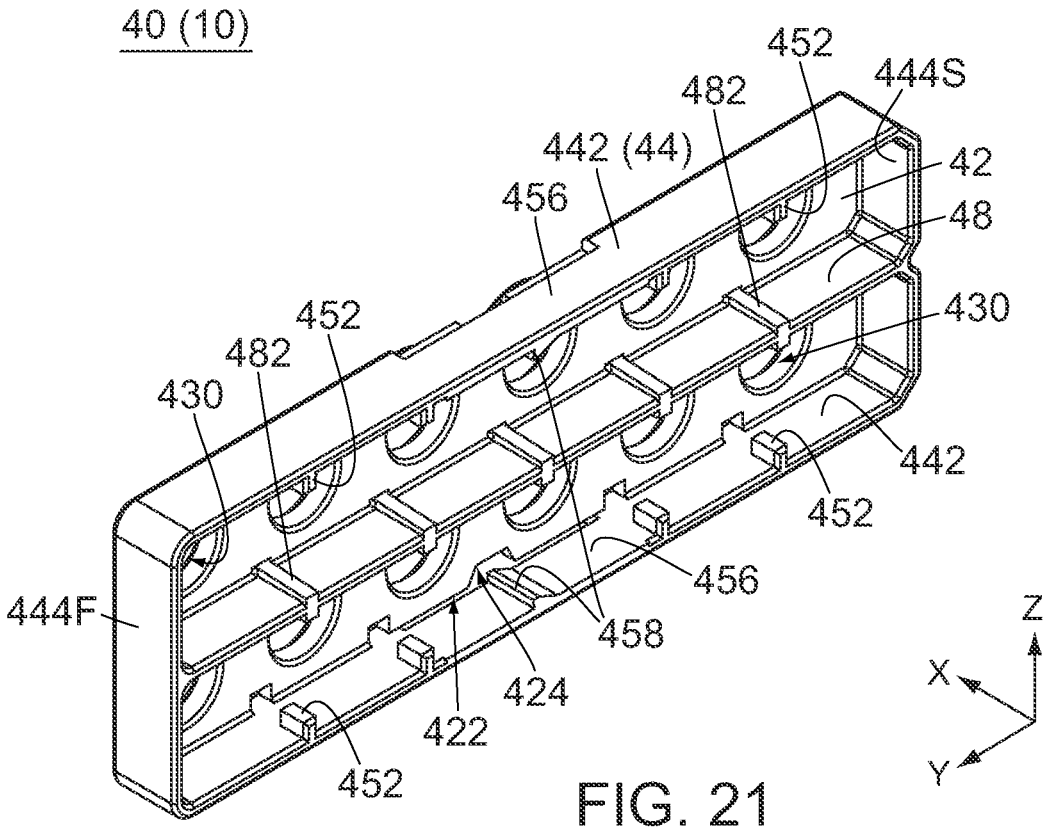
FIG. 21 is another perspective view showing the front insulator of FIG. 20.

Referring to FIGS. 20 and 21, the front insulator 40 of the present embodiment has a front plate 42, a peripheral wall 44 and a beam 48. The front plate 42 has a flat-plate shape as a whole and extends in parallel to the perpendicular plane (YZ-plane). The peripheral wall 44 projects rearward from the edge of the front plate 42 in the YZ-plane. The peripheral wall 44 has two attached walls 442, a first coupling wall 444F and a second coupling wall 444S. The two attached walls 442 extend along an upper edge and a lower edge, or a positive Z-side edge and a negative Z-side edge of the front plate 42, respectively. The first coupling wall 444F couples positive Y-side ends of the two attached walls 442 to each other, and the second coupling wall 444S couples negative Y-side ends of the two attached walls 442 to each other. However, the structure of the front insulator 40 is not limited thereto but can be variously modified.

Referring to FIG. 21, the beam 48 projects rearward from a rear surface, or a negative X-side surface, of the front plate 42. The beam 48 is located at the middle of the front insulator 40 in the upper-lower direction (Z-direction). The beam 48 extends along the perpendicular direction (Y-direction) to be connected to the first coupling wall 444F and the second coupling wall 444S.

Hereafter, explanation will be made about a holding mechanism for the terminals 20 (see FIG. 11).

Figure 14:
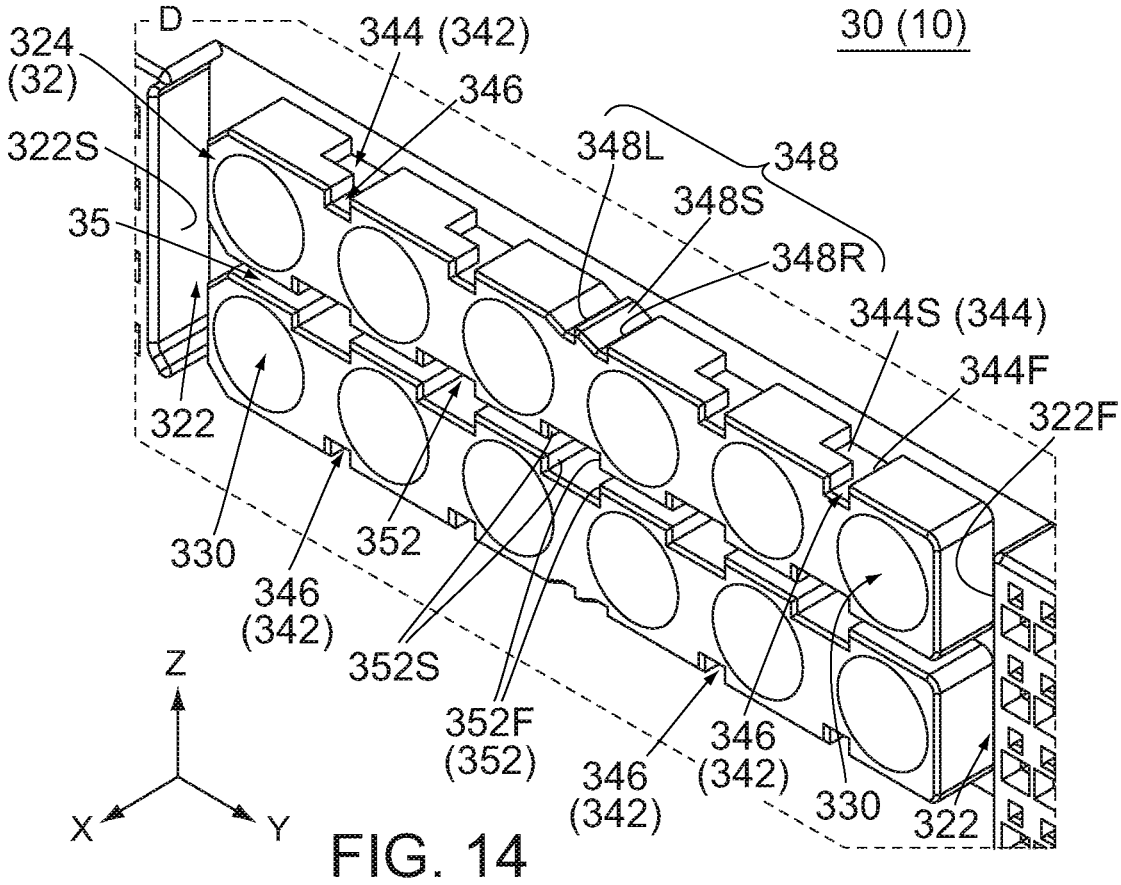
FIG. 14 is a perspective view showing a part of the base insulator enclosed by dashed line D of FIG. 13.
Figure 15:
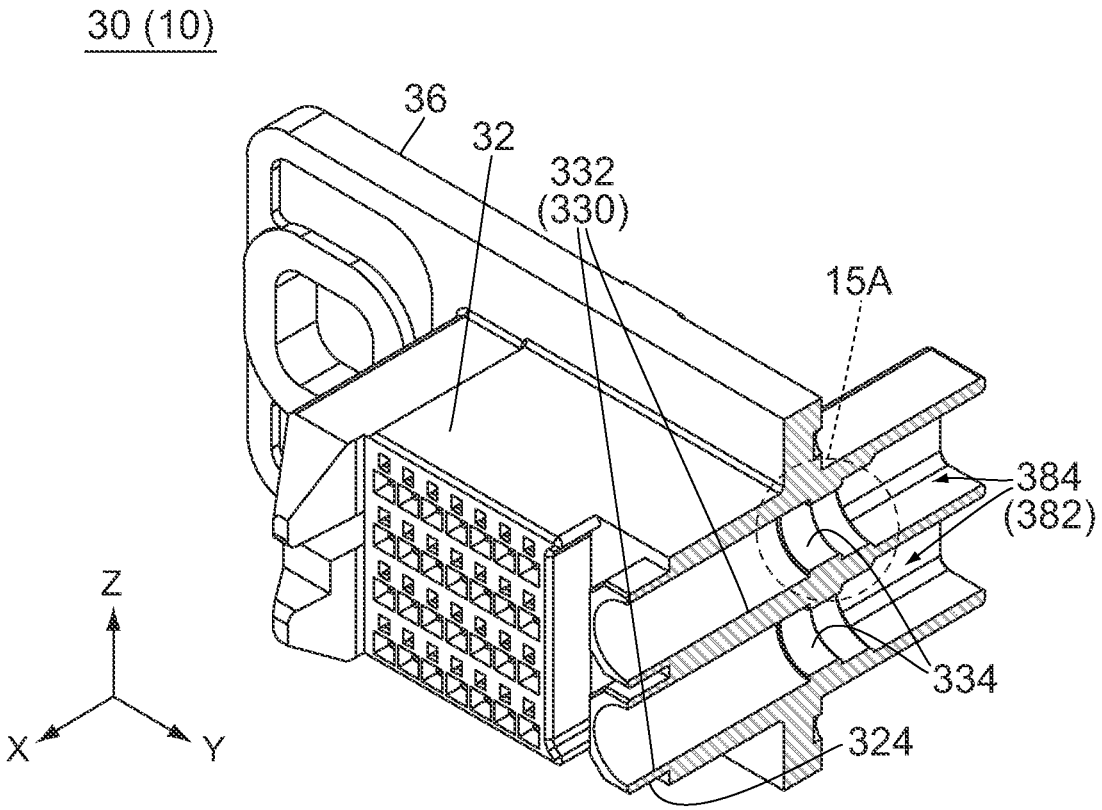
FIG. 15 is a partially cut-away, perspective view showing the base insulator of FIG. 13.
Figure 15A:
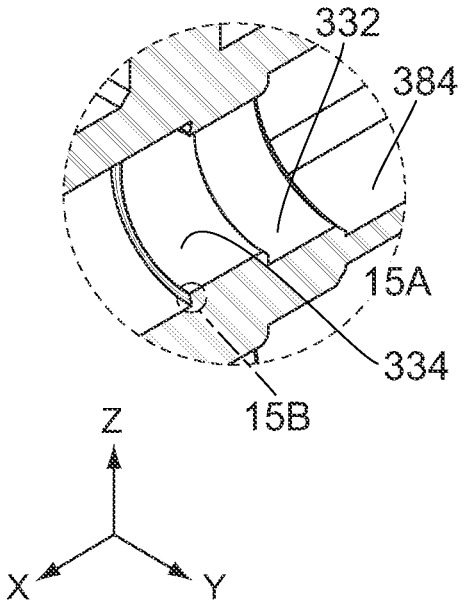
FIG. 15A is an enlarged, perspective view of detail 15A in FIG. 15 showing a part of a holding hole.
Figure 15B:
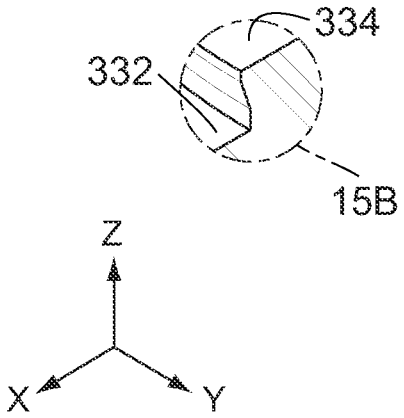
FIG. 15B is an enlarged, perspective view of detail 15B in FIG. 15A showing a part of a retaining portion of the holding hole further enlarged.

Referring to FIGS. 13 and 14, the base insulator 30 is formed with a plurality of holding holes 330. Referring to FIGS. 15, 15A and 15B, the holding holes 330 correspond to the cable-receiving holes 384, respectively. Each of the holding holes 330 is a hole having a cylindrical shape as a whole and extends in the front-rear direction (X-direction). Each of the holding holes 330 passes through the front portion 32 and the flange 36 in the X-direction to communicate with the corresponding cable-receiving hole 384. Each of the holding holes 330 opens forward at the attachment portion 324 and opens rearward at the cable-receiving portion 382.

Each of the holding holes 330 has an inner wall 332 of a cylindrical shape. Each of the holding holes 330 is provided with a retaining portion 334 located therewithin. The retaining portion 334 is a protrusion protruding inward in the radial direction from the inner wall 332 of the holding hole 330 and has an annular shape in the perpendicular plane (YZ-plane). Thus, the retaining portion 334 protrudes from the inner wall 332 toward the center of the holding hole 330 while enclosing the holding hole 330 in an annular shape.

Referring to FIG. 5, the holding holes 330 correspond to the terminals 20, respectively. Each of the holding holes 330 is larger than the cylindrical portion 22 of the corresponding terminal 20 in the perpendicular plane (YZ-plane). In detail, the inner diameter of the inner wall 332 of the holding hole 330 is larger than the outer diameter of the cylindrical portion 22 in the YZ-plane. The inner diameter of the retaining portion 334 is smaller than the inner diameter of the inner wall 332 but is slightly larger than the outer diameter of the cylindrical portion 22 in the YZ-plane.

Figure 17:
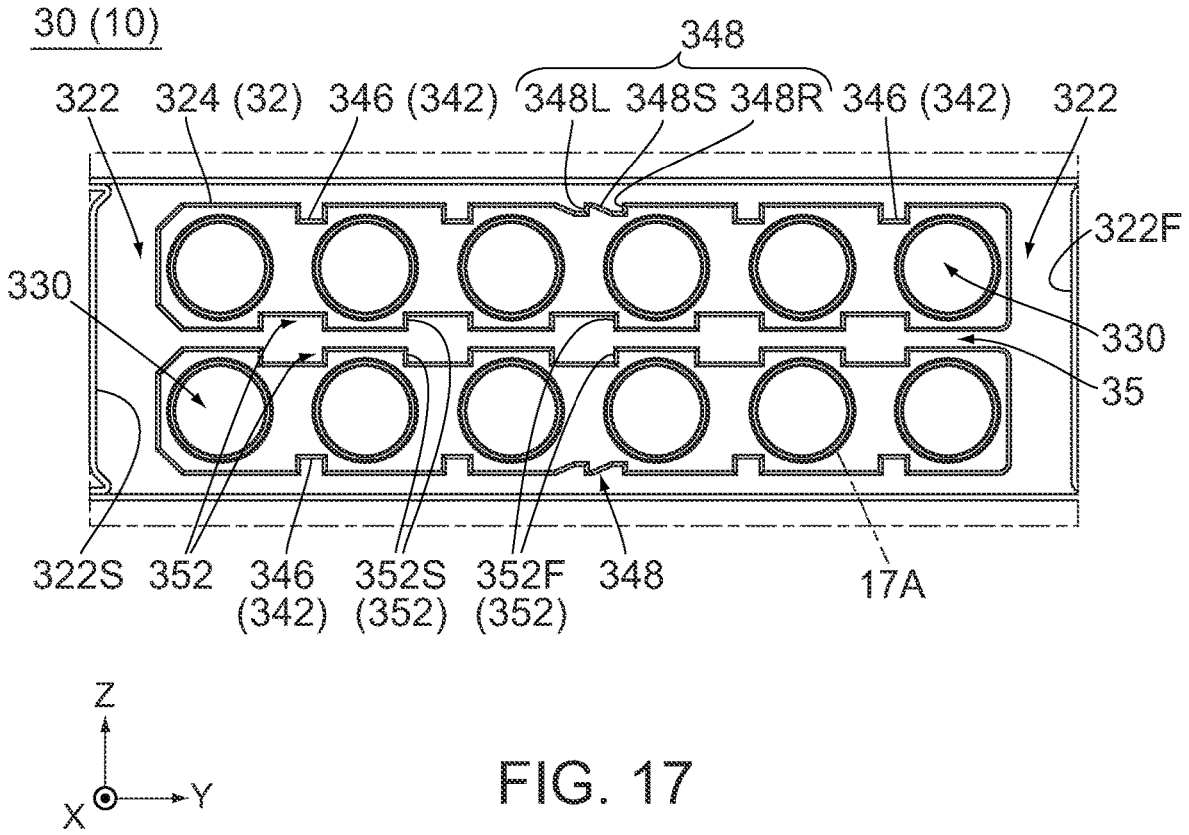
FIG. 17 is a front view showing a part of the base insulator of FIG. 13.
Figure 17A:
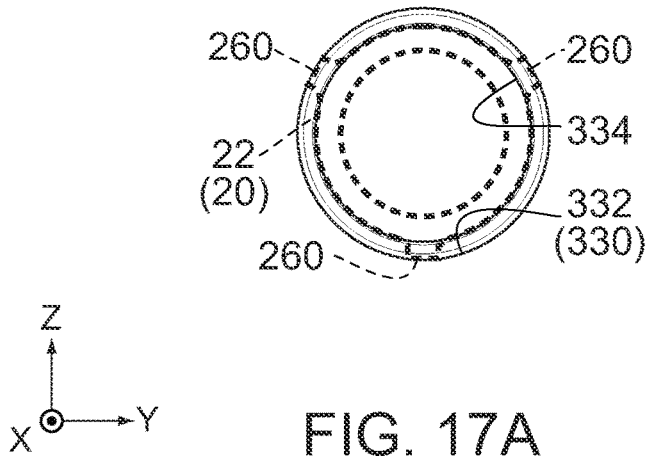
FIG. 17A is an enlarged, front view of detail 17A in FIG. 17 showing one of the holding holes and illustrating with dashed line a position of a cylindrical portion of the terminal relative to the holding hole.
Figure 19:
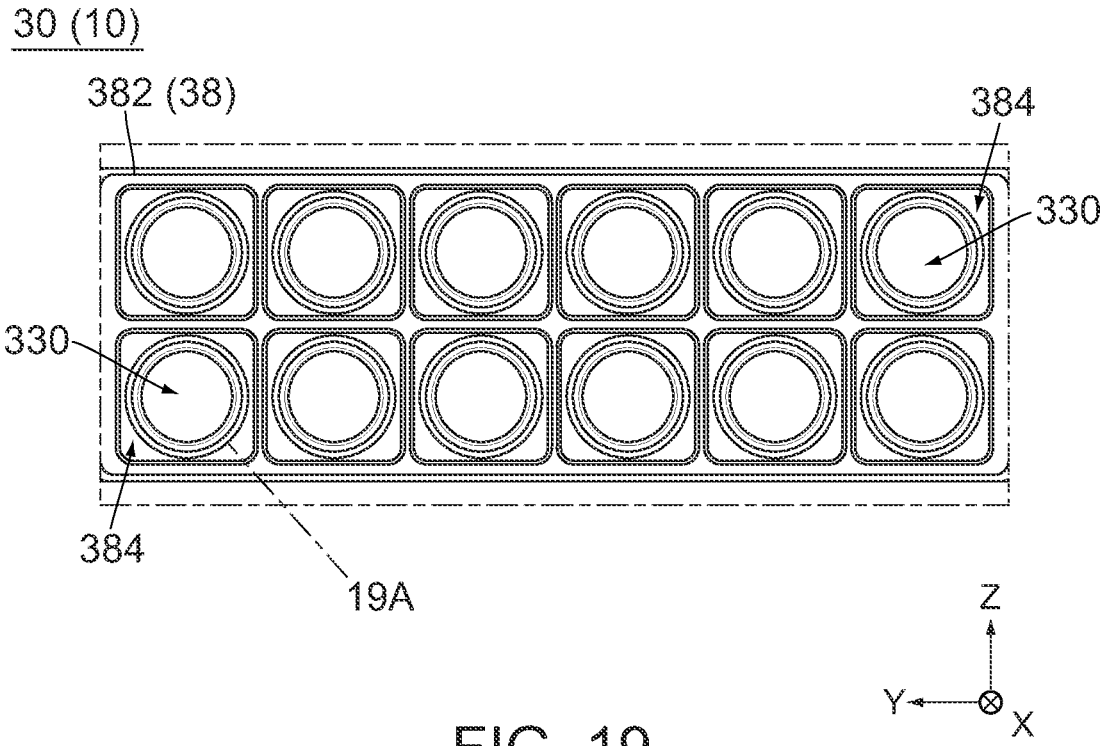
FIG. 19 is a rear view showing a part of the base insulator of FIG. 13.
Figure 19A:
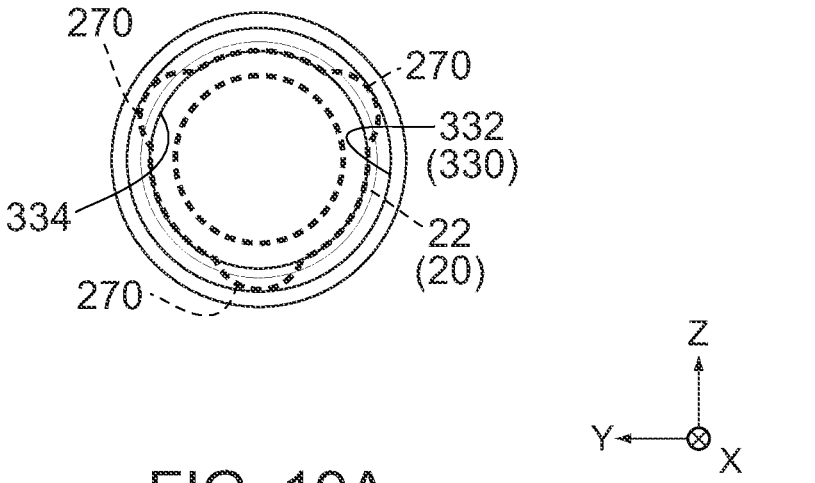
FIG. 19A is an enlarged, rear view of detail 19A in FIG. 19 showing one of the holding holes and illustrating with dashed line a position of the cylindrical portion of the terminal relative to the holding hole.

Referring to FIGS. 5, 15, 15A and 15B, each of the terminals 20 is connected to the corresponding cable 82 and then inserted into the corresponding holding hole 330 from behind. As the terminal 20 is inserted into the holding hole 330, the rear ends of the lances 260 of the terminal 20 ride over the retaining portion 334 of the holding hole 330 with an inward movement in the radial direction. The rear ends of the lances 260 located beyond the retaining portion 334 are moved outward in the radial direction. Referring also to FIGS. 19 and 19A, as the insertion of the terminal 20 into the holding hole 330 continues, the stoppers 270 of the terminal 20 are brought into abutment with a rear surface of the retaining portion 334 so that the forward movement of the terminal 20 is stopped. Referring to FIGS. 17 and 17A, if the thus-located terminal 20 is forced to be moved rearward, the rear ends of the lances 260 are brought into abutment with a front surface, or a positive X-side surface, of the retaining portion 334 so that the rearward movement of the terminal 20 is stopped.

Referring to FIG. 5, for each of the holding holes 330, the retaining portion 334 is located between the rear ends of the lances 260 and the stoppers 270 of the inserted terminal 20 in the front-rear direction (X-direction) to keep the terminal 20 at a predetermined position in the holding hole 330. Thus, each of the terminals 20 is held in the corresponding holding hole 330 and is prevented from coming off the holding hole 330.

Referring to FIG. 12, each of the terminals 20 of the present embodiment is provided with three of the lances 260 and three of the stoppers 270. The three lances 260 are located so that their arrangement is 120 degrees rotational symmetry in the perpendicular plane (YZ-plane). The three stoppers 270 are also located so that their arrangement is 120 degrees rotational symmetry in the YZ-plane. This structure helps to more securely prevent the terminal 20 from coming off the holding hole 330 (see FIG. 5) and to more securely keep the terminal 20 at the predetermined position in the holding hole 330. However the present invention is not limited thereto. For example, each of the number of the lances 260 and the number of the stoppers 270 may be one or two and may be four or more. Moreover, the arrangement of the lances 260 and the arrangement of the stoppers 270 are not limited to those of the present embodiment.

Referring to FIGS. 17, 17A, 19 and 19A, according to the present embodiment, the retaining portion 334 is located between the rear ends of the lances 260 and the stoppers 270 regardless of the angle at which the terminal 20 is rotated. Each of the terminals 20 is held in the thus-formed corresponding holding hole 330 to be rotatable. Referring to FIGS. 15, 15A and 15B, in the present embodiment, a part of the front surface of the retaining portion 334 located at the boundary with the inner wall 332 is slightly recessed rearward. The thus-formed retaining portion 334 is capable of more securely preventing the terminal 20 (see FIG. 5) from coming off the holding hole 330. However the present invention is not limited thereto, but the retaining portion 334 can be formed into various shapes.

Referring to FIGS. 5, 17, 17A, 19 and 19A, each of the holding holes 330 is formed with a gap which is located between the inner wall 332 thereof and the cylindrical portion 22 of the corresponding terminal 20. With this structure, when a jig (not shown) is inserted into the aforementioned gap under a state where the front insulator 40 is not attached to the base insulator 30, the retention of the lance 260 maintained by the retaining portion 334 can be released. In detail, when the jig is inserted into the gap to move the rear end of the lance 260 inward in the radial direction, the retention can be released. The thus-released terminal 20 can be pulled out rearward. Thus, the connector 10 according to the present embodiment allows easy replacement of the terminal 20 in the assembly of the connector 10.

Hereafter, explanation will be made about an electric shock prevention mechanism of the connector 10.

Referring to FIGS. 20 to 23, the front insulator 40 is formed with a plurality of passing holes 430. Each of the passing holes 430 has a circular shape in the perpendicular plane (YZ-plane) and passes through the front plate 42 of the front insulator 40 in the front-rear direction (X-direction). Referring to FIG. 5, the passing holes 430 correspond to the terminals 20, respectively, and correspond to the holding holes 330, respectively. Referring to FIG. 5, each of the passing holes 430 is smaller than the cylindrical portion 22 of the corresponding terminal 20 in the YZ-plane. In detail, the inner diameter of an inner wall of the passing holes 430 is smaller than the outer diameter of the cylindrical portion 22 in the YZ-plane.

Figure 25:
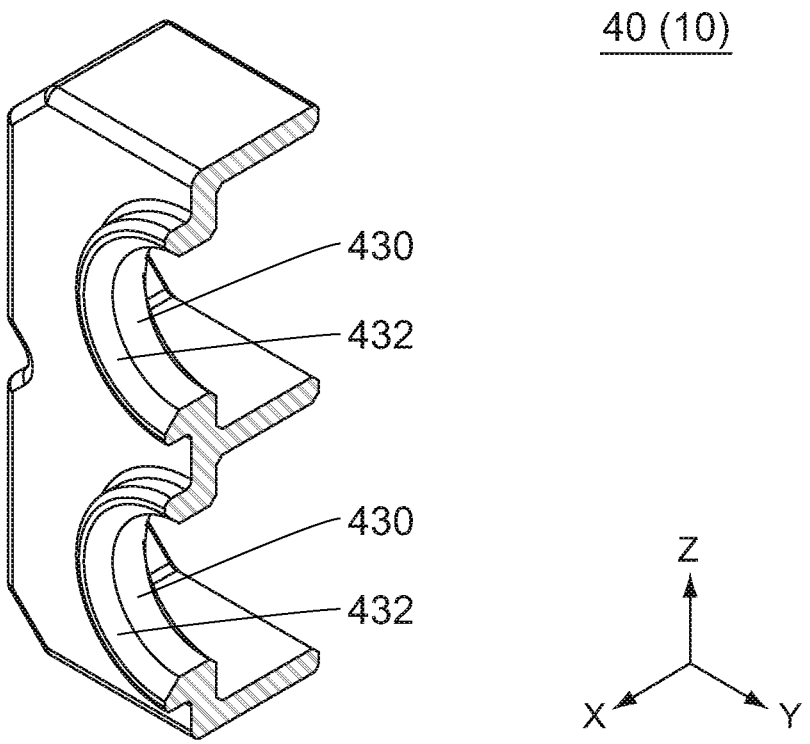
FIG. 25 is another partially cut-away, perspective view showing the front insulator of FIG. 20.

Referring to FIGS. 20 and 25, the front plate 42 is provided with a plurality of guide portions 432 which correspond to the passing holes 430, respectively. Each of the guide portions 432 has an annular shape in the perpendicular plane (YZ-plane) and projects forward from the front plate 42 with increase of its inner diameter. Referring to FIGS. 4, 4A and 5, in a mating process in which the connector 10 is mated with the mating connector 70, the guide portion 432 guides the mating contact portion 722 of the mating terminal 72 toward the receiving hole 24 of the terminal 20.

Referring to FIG. 5, when the front insulator 40 is attached to the base insulator 30, the passing holes 430, each of which is smaller than the cylindrical portion 22 of the terminal 20, are located in front of the holding holes 330, respectively, in the front-rear direction (X-direction). This structure prevents electrical shock which might be caused by contact with the terminal 20. In detail, the passing hole 430 is smaller than the test finger specified in safety standards such as IEC60335-1 of International Electrotechnical Commission. Therefore, even if an operator tries to insert his/her finger into the passing hole 430, the finger does not reach the cylindrical portion 22 located within the holding hole 330. Thus, the connector 10 according to the present embodiment has an electric shock prevention function.

Hereafter, explanation will be made about the structure of the attachment portion 324 of the base insulator 30 and the structure of the front insulator 40 which corresponds to the attachment portion 324.

Referring to FIGS. 14, 17 and 17A, the holding holes 330 are located in the attachment portion 324 of the base insulator 30 and are arranged in two rows, or in upper and lower rows. In each row, six of the holding holes 330 are arranged along the perpendicular direction (Y-direction). The attachment portion 324 of the base insulator 30 is formed with a receiving groove 35 and a plurality of rib-receiving portions 352. The receiving groove 35 is recessed rearward in the front-rear direction (X-direction) and is located between the two rows of the holding holes 330 in the upper-lower direction (Z-direction). The receiving groove 35 extends in the Y-direction to be connected to the two side grooves 322.

The receiving groove 35 has five parts each recessed upward and downward, so that five pairs of the rib-receiving portions 352 are formed. The rib-receiving portions 352 of each pair include the rib-receiving portion 352 that is recessed upward from the receiving groove 35 and the rib-receiving portion 352 that is recessed downward from the receiving groove 35. Each of the rib-receiving portions 352 is connected to the receiving groove 35 in the upper-lower direction (Z-direction) and extends along the front-rear direction (X-direction). Each of the rib-receiving portions 352 is located between a first edge surface 352F and a second edge surface 352S in the perpendicular direction (Y-direction). The first edge surface 352F and the second edge surface 352S are inner wall surfaces of the rib-receiving portion 352 and face each other in the Y-direction.

Referring to FIGS. 14, 17, 17A and 18, the base insulator 30 has a plurality of L-shaped channels 342 and two lock portions 348. According to the present embodiment, eight of the L-shaped channels 342 are provided so as to have shapes the same as one another. Four of the L-shaped channels 342 and one of the lock portions 348 are provided on an upper surface, or a positive Z-side surface, of the attachment portion 324. The remaining four of the L-shaped channels 342 and a remaining one of the lock portions 348 are provided on a lower surface, or a negative Z-side surface, of the attachment portion 324. The lock portion 348 and the L-shaped channels 342 of the upper surface of the attachment portion 324 is arranged to be a mirror image of the lock portion 348 and the L-shaped channels 342 of the lower surface of the attachment portion 324 with respect to the XY-plane.

For each of the upper surface and the lower surface of the attachment portion 324, the lock portion 348 is located at the middle of the attachment portion 324 in the perpendicular direction (Y-direction). Each of the lock portions 348 has a regulation surface 348R, a ramp 348S and a lock surface 348L. The regulation surface 348R, the ramp 348S and the lock surface 348L are arranged in this order along the negative Y-direction. The regulation surface 348R and the ramp 348S are inner wall surfaces of a recess formed on each of the upper surface and the lower surface of the attachment portion 324 and are located at opposite sides of the recess in the Y-direction. The ramp 348S is apart from the regulation surface 348R in the Y-direction. The regulation surface 348R is perpendicular to the Y-direction. The ramp 348S is a gently sloping surface. The lock surface 348L is an inner wall surface of another recess formed on each of the upper surface and the lower surface of the attachment portion 324 and is perpendicular to the Y-direction. The lock surface 348L is apart from the ramp 348S in the Y-direction.

In each of the upper surface and the lower surface of the attachment portion 324, two of the four L-shaped channels 342 and the remaining two of the four L-shaped channels 342 are arranged to put the lock portion 348 therebetween in the perpendicular direction (Y-direction). Each of the L-shaped channels 342 has a regulation channel 344 and a guide channel 346. Each of the regulation channel 344 and the guide channel 346 is a recess formed on the upper surface or the lower surface of the attachment portion 324 and is recessed toward the receiving groove 35 in the upper-lower direction (Z-direction), or inward in the Z-direction.

Figure 18:
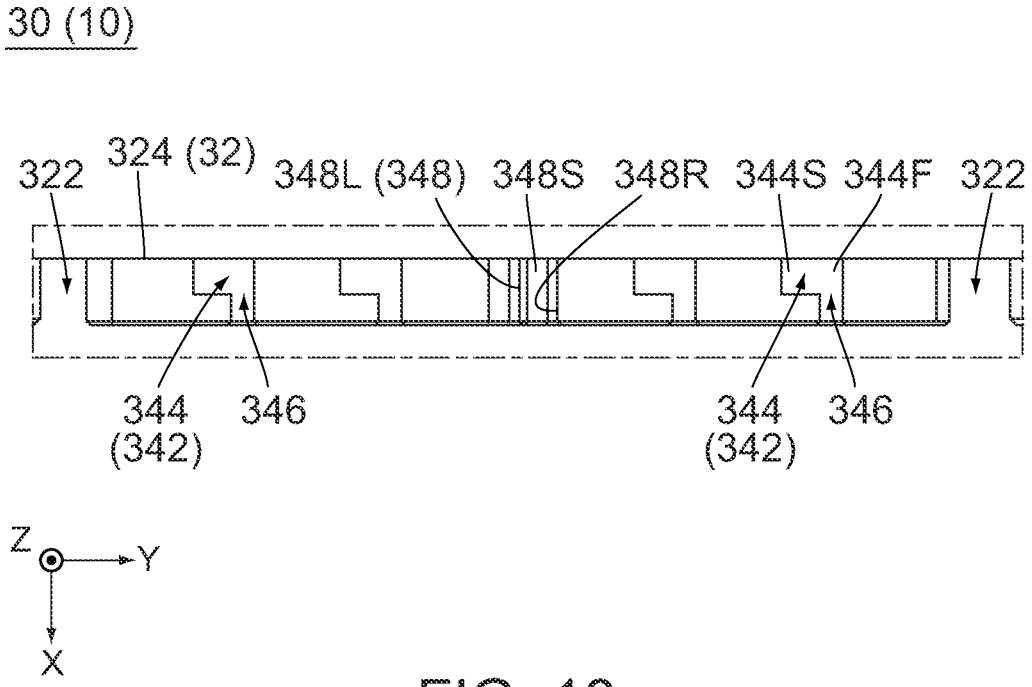
FIG. 18 is a top view showing a part of the base insulator of FIG. 13.

Referring to FIGS. 14 and 18, each of the regulation channels 344 is located at a rear end of the attachment portion 324 in the front-rear direction (X-direction). In each of the L-shaped channels 342, the regulation channel 344 extends in the perpendicular direction (Y-direction) to have opposite ends in the Y-direction, namely a first end 344F and a second end 344S. The first end 344F is one of the opposite ends of the regulation channel 344 which is nearer to the first surface 322F, and the second end 344S is a remaining one of the opposite ends which is nearer to the second surface 322S. In each of the L-shaped channels 342, the guide channel 346 extends forward in the X-direction from the end (first end 344F) of the regulation channel 344 to open forward. In contrast, the attachment portion 324 is partially located in front of the second end 344S of the regulation channel 344. Thus, the second end 344S is invisible from the front even when the front insulator 40 (see FIG. 20) is not attached.

Referring to FIGS. 14 and 21, a distance between the two attached walls 442 of the peripheral wall 44 of the front insulator 40 in the upper-lower direction (Z-direction) is slightly longer than another distance between the upper surface and the lower surface of the attachment portion 324 of the base insulator 30 in the Z-direction, and a distance between the first coupling wall 444F and the second coupling wall 444S of the peripheral wall 44 in the perpendicular direction (Y-direction) is longer than another distance between opposite side surfaces of the attachment portion 324 in the Y-direction. As described below, the peripheral wall 44 and the beam 48 are provided with parts that positionally and structurally correspond to the parts of the attachment portion 324.

Referring to FIG. 21, the beam 48 is provided with a plurality of ribs 482. The beam 48 has five parts each protruding upward and downward, so that five pairs of the ribs 482 are formed. The ribs 482 of each pair include the rib 482 that protrudes upward from the beam 48 and the rib 482 that protrudes downward from the beam 48. Each of the ribs 482 extends in the front-rear direction (X-direction) to be connected to the rear surface of the front plate 42.

Referring to FIGS. 14 and 21, the beam 48 is provided so as to correspond to the receiving groove 35 of the attachment portion 324, and the ribs 482 are provided so as to correspond to the rib-receiving portions 352, respectively. In the upper-lower direction (Z-direction), a size of a part of the beam 48 that is not provided with the rib 482 is smaller than a size of a part of the receiving groove 35 that is not formed with the rib-receiving portion 352. In the Z-direction, a size of another part of the beam 48 that is provided with the rib 482 is larger than the size of the part of the receiving groove 35 that is not formed with the rib-receiving portion 352. In the YZ-plane, a size of the part of the beam 48 that is provided with the rib 482 is smaller than a size of a part of the receiving groove 35 that is formed with the rib-receiving portion 352.

The front insulator 40 of the present embodiment is reinforced by the beam 48 connected to the front plate 42. In particular, according to the present embodiment, since a plurality of the ribs 482 connected to the front plate 42 are provided, the front insulator 40 is hard to be damaged. However the present invention is not limited thereto, but the beam 48 and the ribs 482 may be provided as necessary. The number and the arrangement of the ribs 482 can be variously modified.

Figure 22:
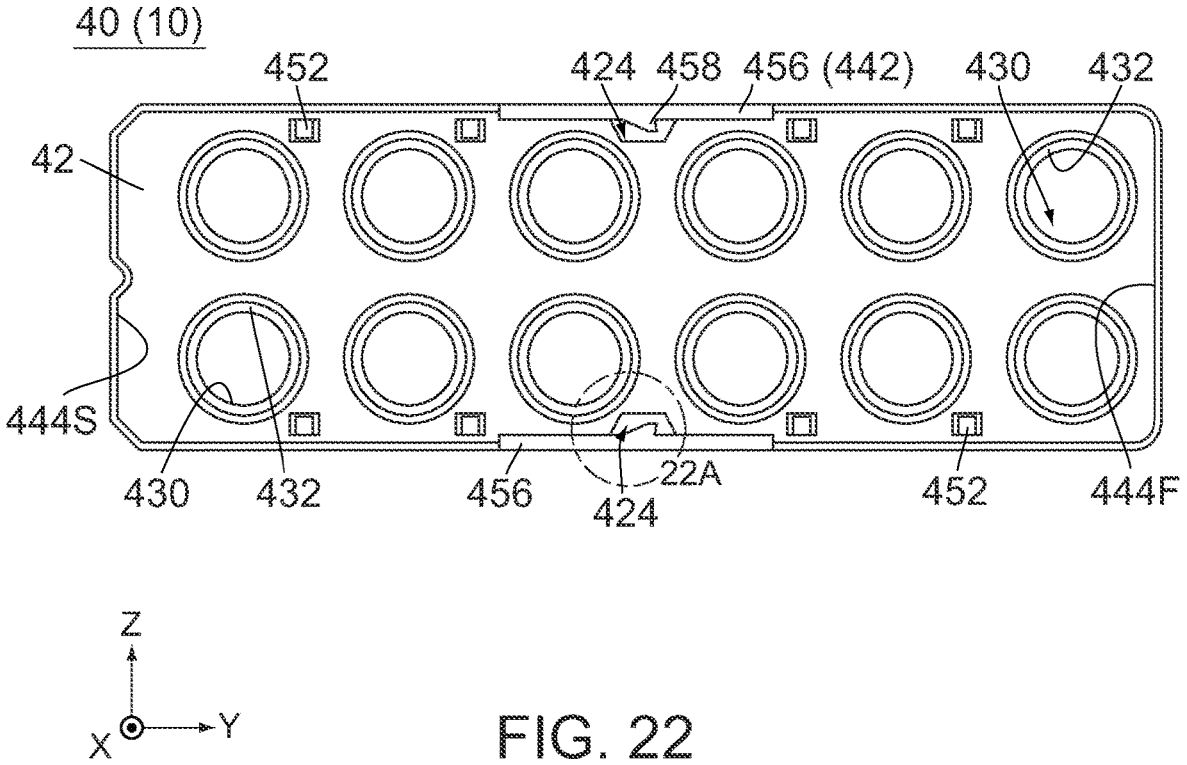
FIG. 22 is a front view showing the front insulator of FIG. 20.
Figure 23:
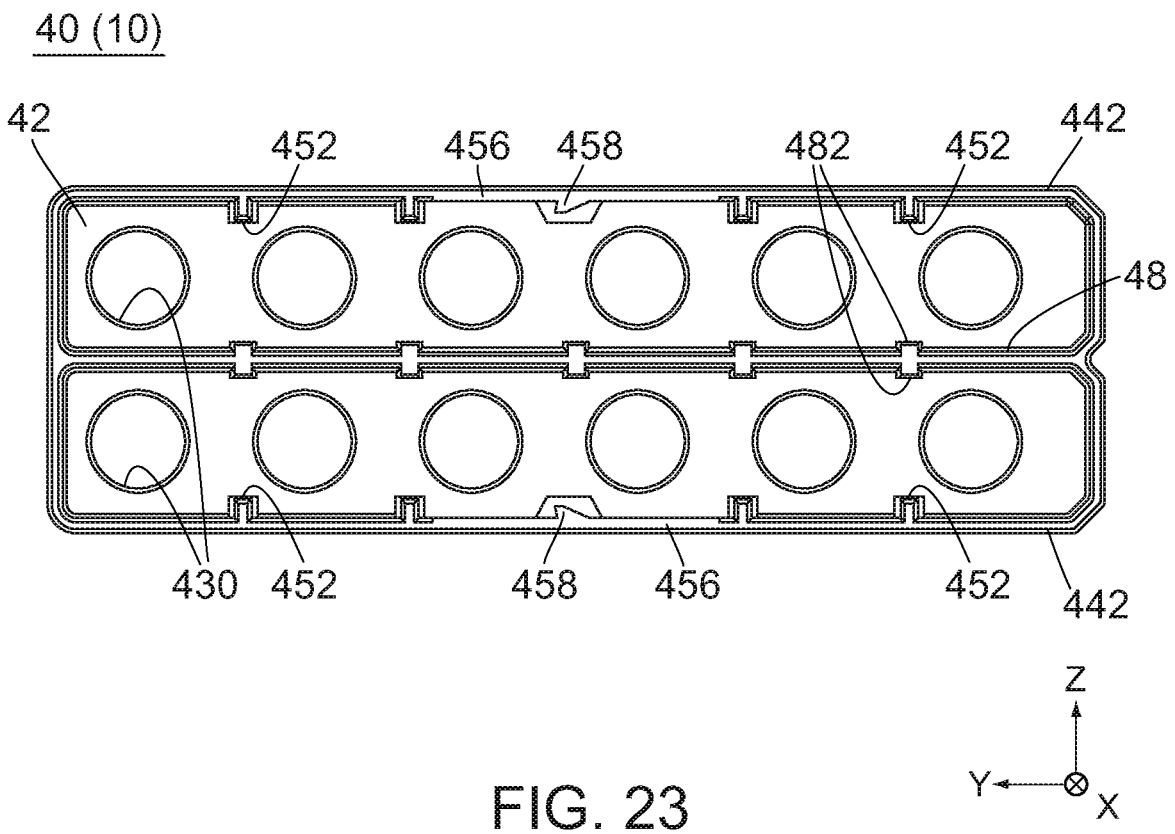
FIG. 23 is a rear view showing the front insulator of FIG. 20.
Figure 24:
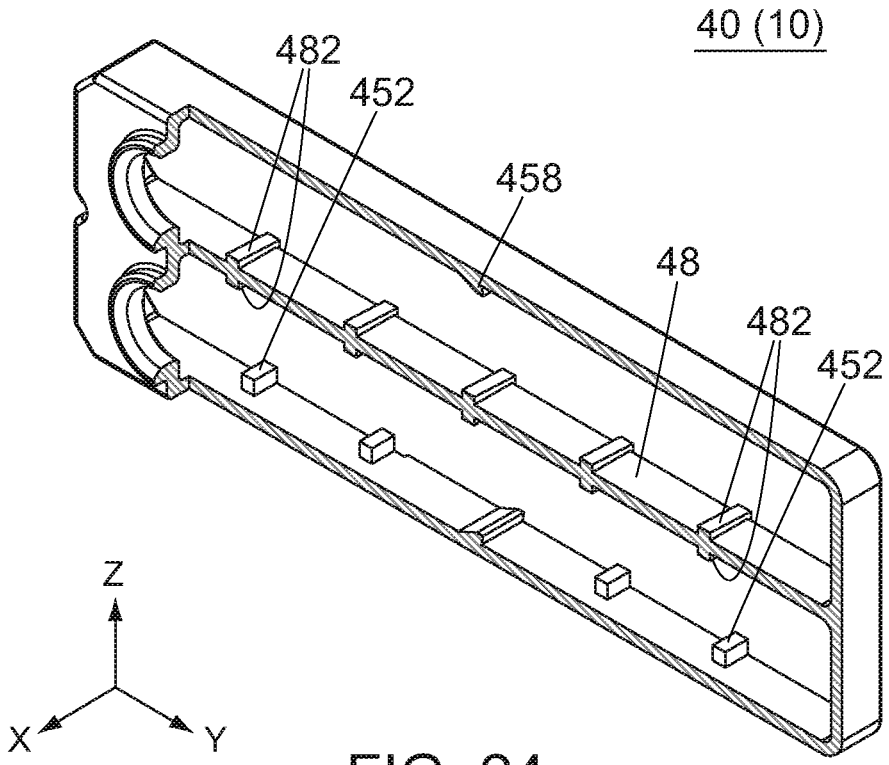
FIG. 24 is a partially cut-away, perspective view showing the front insulator of FIG. 20.

Referring to FIGS. 20 to 24, the front insulator 40 has a plurality of bosses 452, two support portions 456 and two locked portions 458. According to the present embodiment, eight of the bosses 452 are provided so as to have shapes the same as one another. As shown in FIG. 23, four of the bosses 452, one of the support portions 456 and one of the locked portions 458 are provided on the upper attached wall 442. The remaining four of the bosses 452, a remaining one of the support portions 456 and a remaining one of the locked portions 458 are provided on the lower attached wall 442. The bosses 452, the support portions 456 and the locked portions 458 of the upper attached wall 442 are arranged to be a mirror image of the bosses 452, the support portions 456 and the locked portions 458 of the lower attached wall 442 with respect to the XY-plane.

Referring to FIGS. 20 and 21, the support portion 456 of each of the attached walls 442 is located at the middle thereof in the perpendicular direction (Y-direction). In detail, each of the attached walls 442 is formed with a notch 422 located at the middle thereof in the Y-direction. The notch 422 cuts out a part of the attached wall 442 located at the middle thereof in the Y-direction and cuts out a part of the front plate 42 located at the middle thereof in the Y-direction. The notch 422 separates the support portion 456 from the front plate 42. The thus-formed support portion 456 is resiliently deformable. The locked portion 458 is supported by the support portion 456. The locked portion 458 is located at the middle of the support portion 456 in the Y-direction and protrudes from the attached wall 442 toward the beam 48 in the upper-lower direction (Z-direction), or inward in the Z-direction. The locked portion 458 is movable in the Z-direction in accordance with resilient deformation of the support portion 456.

Figure 22A:
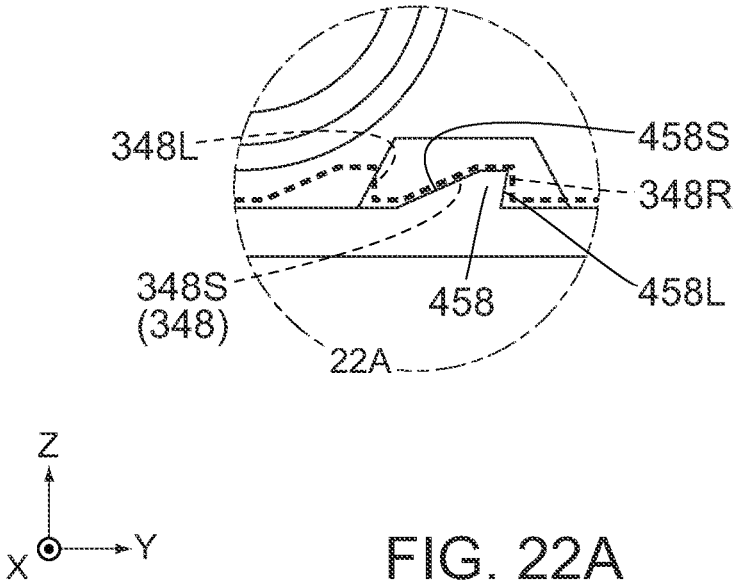
FIG. 22A is an enlarged, front view of detail 22A in FIG. 22 showing the locked portion and therearound and illustrating with dashed line a position of a lock portion of the base insulator relative to the locked portion.

Referring to FIGS. 22 and 22A, each of the locked portions 458 has a locked surface 458L and a ramp 458S. The locked surface 458L and the ramp 458S are opposite side surfaces of the locked portion 458 and are arranged in this order along the negative Y-direction. The ramp 458S is apart from the locked surface 458L in the perpendicular direction (Y-direction). Each of the locked surface 458L and the ramp 458S is a sloping surface oblique to both the Y-direction and the upper-lower direction (Z-direction). In particular, the locked surface 458L extends inward in the Z-direction while slightly extending toward the second surface 322S in the Y-direction. The locked surface 458L is a gently sloping surface.

Referring to FIGS. 21 and 23, in each of the attached walls 442, two of the four bosses 452 and the remaining two of the four bosses 452 are arranged to put the locked portion 458 therebetween in the perpendicular direction (Y-direction). Each of the bosses 452 is a protrusion protruding inward in the upper-lower direction (Z-direction) from the attached wall 442. Each of the bosses 452 has a rectangular shape in the perpendicular plane (YZ-plane) and extends along the X-direction. In detail, each of the bosses 452 extends from a rear end of the attached wall 442 to the middle of the attached wall 442 in the front-rear direction (X-direction).

Referring to FIGS. 14 and 21, the bosses 452 are provided so as to correspond to the guide channels 346 of the attachment portion 324, respectively. In the perpendicular plane (YZ-plane), a size of each of the bosses 452 is smaller than a size of the corresponding guide channel 346. The locked portions 458 are provided so as to correspond to the recesses formed with the regulation surfaces 348R of the attachment portion 324, respectively, and so as to correspond to the recesses formed with the lock surfaces 348L, respectively. In the YZ-plane, a size of each of the locked portions 458 is smaller than a size of the corresponding recess formed with the regulation surface 348R and a size of the corresponding recess formed with the lock surface 348L.

Referring to FIGS. 21, 22 and 22A, the front plate 42 is formed with two windows 424. The windows 424 cut out parts of the front plate 42 together with the notches 422. The notches 422 are located in front of the support portions 456, respectively, and the windows 424 are located in front of the locked portions 458, respectively. The locked portions 458 and the support portions 456 are entirely visible when the front insulator 40 is seen from the front along the front-rear direction (X-direction).

Hereafter, explanation will be made about an attachment method of the front insulator 40 to the base insulator 30 (see FIG. 13).

Referring to FIGS. 9, 10, 10A and 10B, first, the front insulator 40 is put on the attachment portion 324 from the front so that the first coupling wall 444F is close to the first surface 322F of the side groove 322 of the base insulator 30. The position of the thus-located front insulator 40, or the position shown in FIGS. 9, 10, 10A and 10B, is referred to as "first position".

Figure 10:
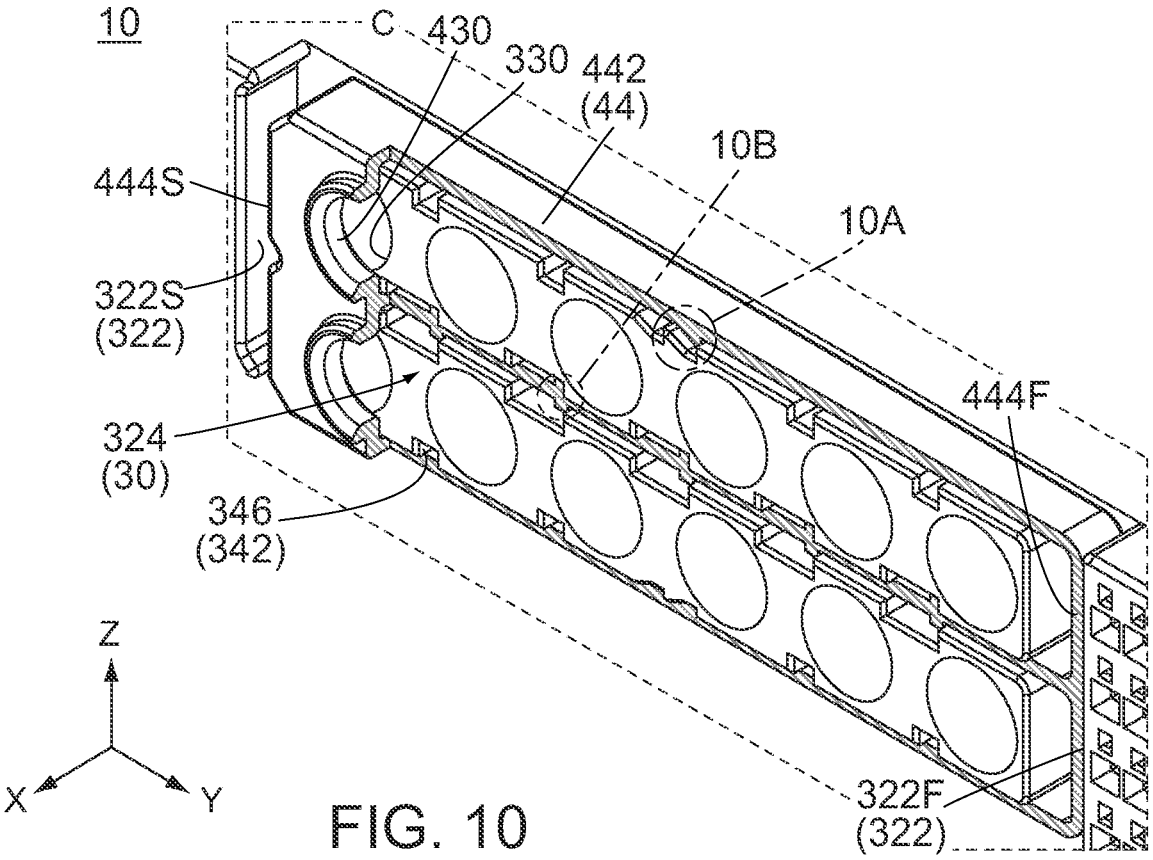
FIG. 10 is a partially cut-away, perspective view showing a part of the connector enclosed by dashed line C of FIG. 9.
Figure 10A:
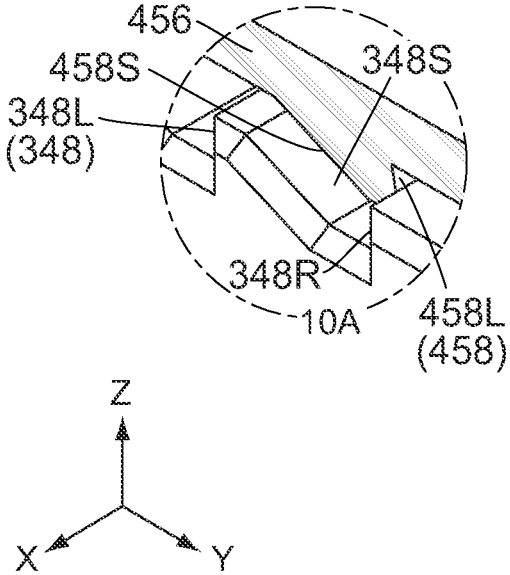
FIGS. 10A and 10B are enlarged, perspective views of details 10A and 10B in FIG. 10 showing the locked portion and therearound and the rib and therearound, respectively.
Figure 10B:
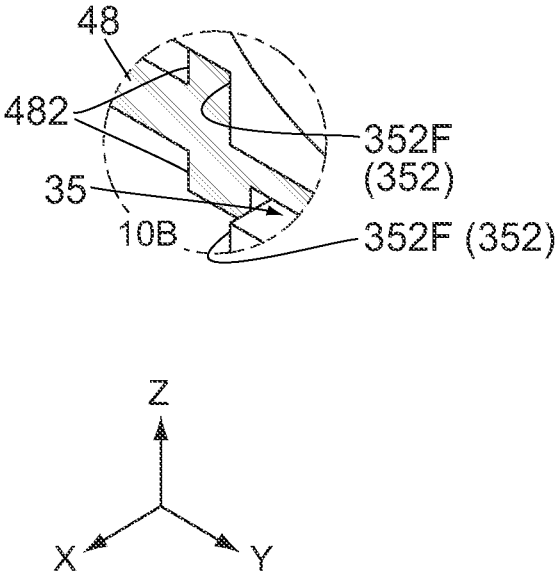

Referring to FIGS. 10, 10A and 10B, when the front insulator 40 is located at the first position, the center of each of the passing holes 430 of the front insulator 40 is apart from the center of the corresponding holding hole 330 of the base insulator 30. Referring to FIGS. 4 and 4A, this arrangement inhibits the mating contact portions 722 of the mating terminals 72 from being inserted into the receiving holes 24 of the terminals 20. Thus, the mating connector 70 cannot be mated with the connector 10.

Referring to FIGS. 10, 10A 10B 14 and 21, when the front insulator 40 is located at the first position, the two attached walls 442 are located over and under the attachment portion 324, respectively. After the bosses 452 of the attached walls 442 pass through the guide channels 346 of the attachment portion 324, respectively, the bosses 452 are received in the regulation channels 344, respectively, and are located at the first ends 344F, respectively. The locked portions 458 of the attached walls 442 are received in the recesses of the attachment portion 324, each of which is formed with the regulation surface 348R, respectively. The locked surfaces 458L of the locked portions 458 are close to the regulation surfaces 348R, respectively. The beam 48 is received in the receiving groove 35 of the attachment portion 324. The ribs 482 of the beam 48 are received in the rib-receiving portions 352 of the attachment portion 324, respectively, so as to be close to the first edge surfaces 352F, respectively.

When the front insulator 40 is located at the first position, the beam 48 received in the receiving groove 35 regulates a movement of the front insulator 40 in the upper-lower direction (Z-direction). The regulation surfaces 348R of the lock portions 348 regulate a movement of the front insulator 40 in the positive Y-direction together with inner wall surfaces of the first ends 344F of the regulation channels 344 and the first edge surfaces 352F of the rib-receiving portions 352. Meanwhile, the second coupling wall 444S is apart from the second surface 322S of the side groove 322. In addition, the ribs 482 are apart from the second edge surfaces 352S of the rib-receiving portions 352, respectively, and the bosses 452 are apart from the second ends 344S of the regulation channels 344, respectively. The thus-located front insulator 40 is movable along an attachment direction (negative Y-direction).

Referring to FIGS. 10, 10A, 10B, 22 and 22A, when the front insulator 40 is moved along the attachment direction (negative Y-direction), the ramps 458S of the locked portions 458 receive outward forces in the upper-lower direction (Z-direction) from the ramps 348S of the lock portions 348, respectively, so that each of the support portions 456 is resiliently deformed. As a result, each of the locked portions 458 is moved along the negative Y-direction while being moved outward in the Z-direction. Referring to FIGS. 7, 7A, 7B, 22 and 22A, when the ramps 458S of the locked portions 458 ride over the ramps 348S of the lock portions 348, respectively, the locked portions 458 return to their initial positions to be received in the recesses of the attachment portion 324, each of which is formed with the lock surface 348L, respectively. The thus-located locked surfaces 458L face the lock surfaces 348L of the lock portions 348, respectively. The position of the thus-located front insulator 40, or the position shown in FIGS. 6 to 8, is referred to as "second position".

Figure 7:
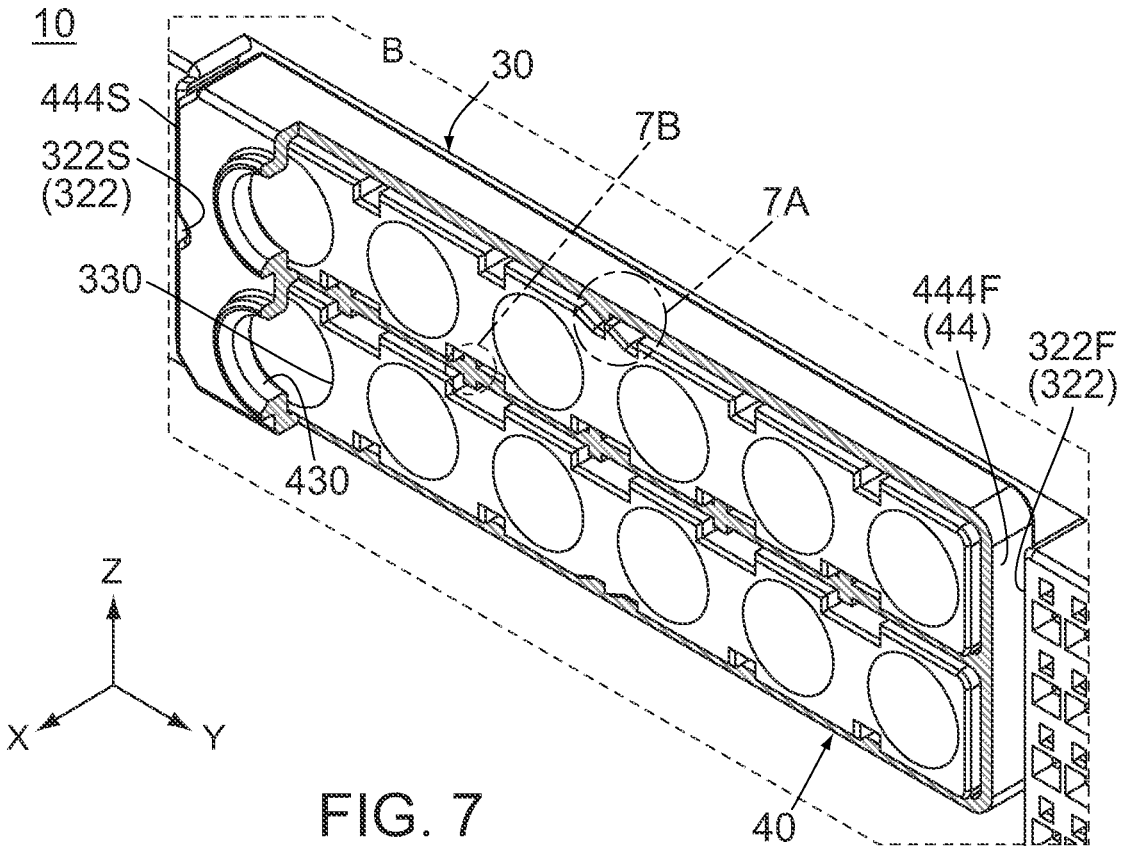
FIG. 7 is a partially cut-away, perspective view showing a part of the connector enclosed by dashed line B of FIG. 6.
Figure 7A:
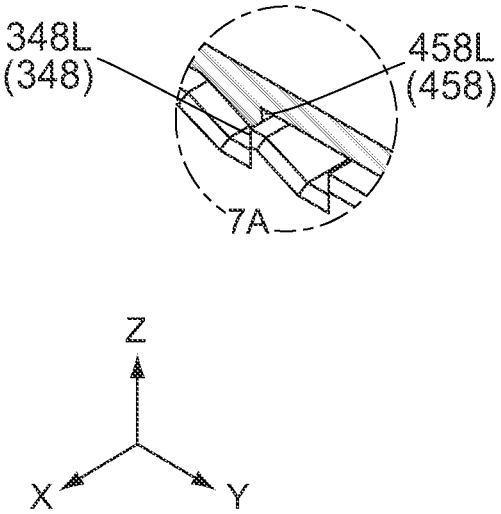
FIGS. 7A and 7B are enlarged, perspective views of details 7A and 7B in FIG. 7 showing a locked portion and therearound and a rib and therearound, respectively.
Figure 7B:
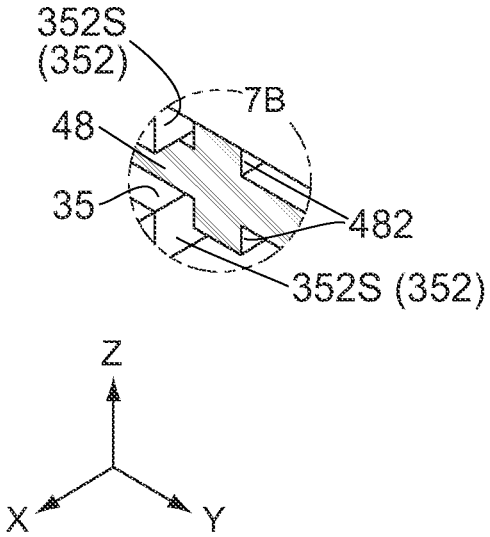
Figure 8:
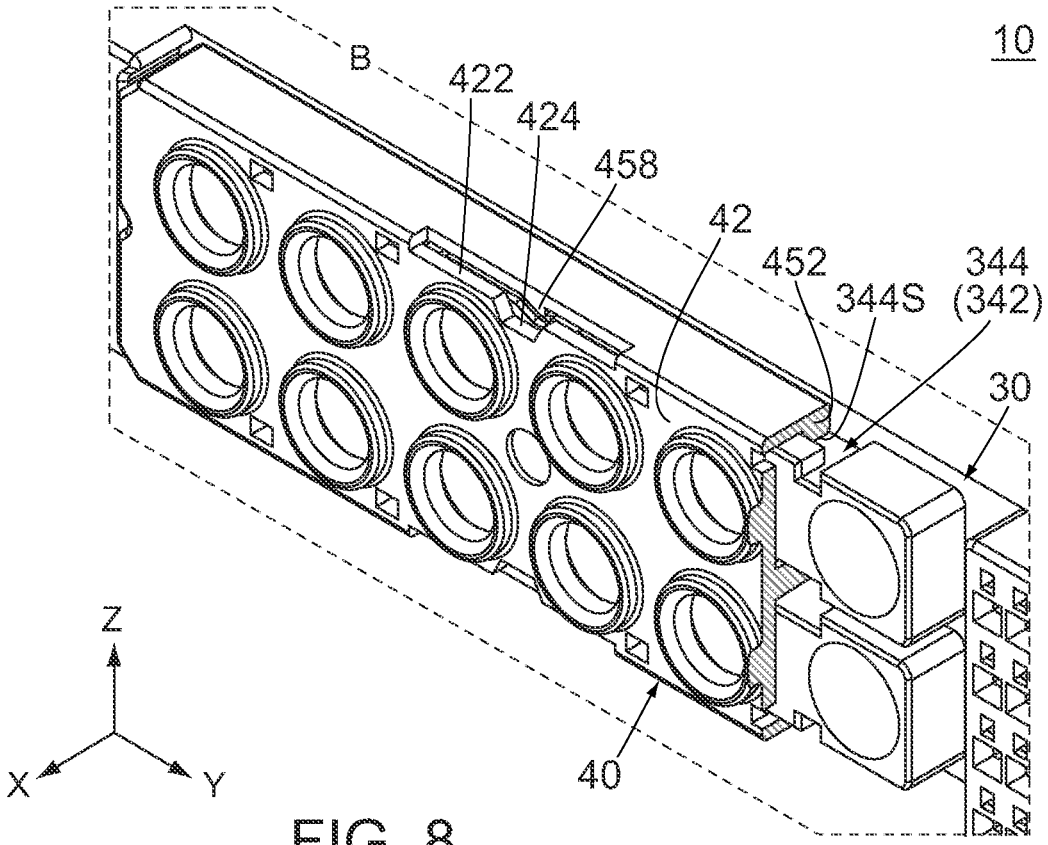
FIG. 8 is another partially cut-away, perspective view showing a part of the connector enclosed by dashed line B of FIG. 6.

Referring to FIGS. 7, 7A and 7B, when the front insulator 40 is located at the second position, the center of each of the passing holes 430 of the front insulator 40 is substantially coincident with the center of the corresponding holding hole 330 of the base insulator 30. Referring to FIGS. 4 and 4A, this arrangement allows the mating contact portions 722 of the mating terminals 72 to be inserted into the receiving holes 24 of the terminals 20, respectively. Thus, the mating connector 70 can be mated with the connector 10.

Figure 6:
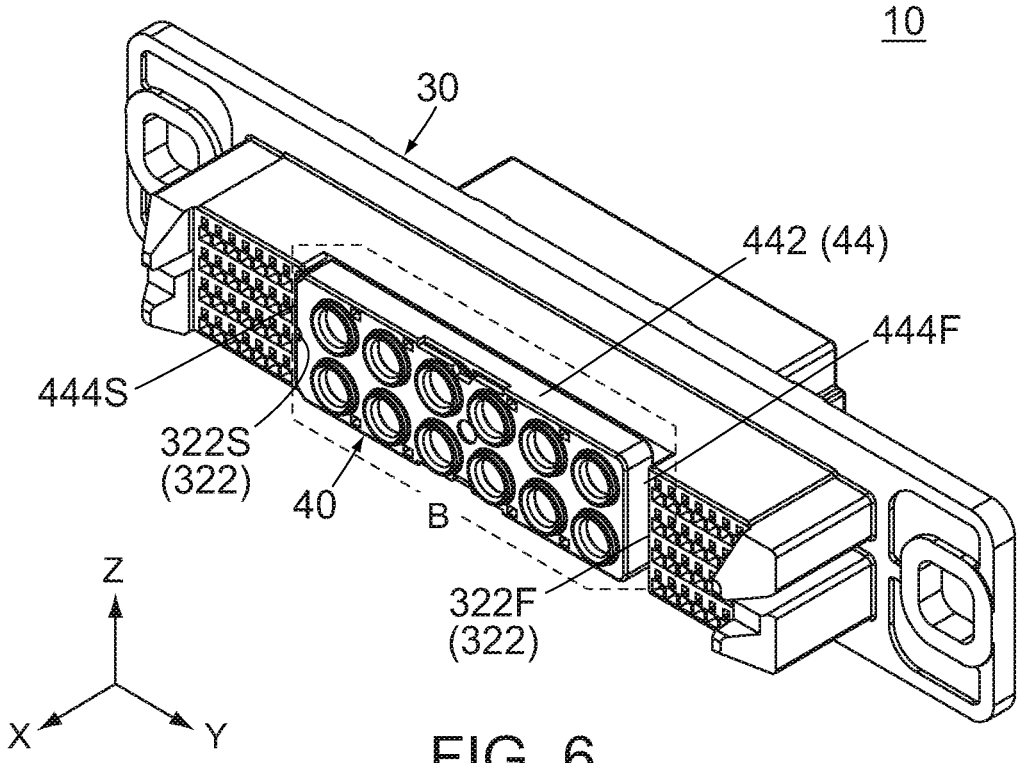
FIG. 6 is a perspective view showing the connector of FIG. 1, wherein the connector is unconnected to the cables, and a front insulator thereof is located at a second position.

Referring to FIG. 6, when the front insulator 40 is located at the second position, the front insulator 40 takes an attached state in which the front insulator 40 is attached to the base insulator 30. Under the attached state, the second coupling wall 444S of the front insulator 40 is close to the second surface 322S of the base insulator 30. Referring to FIGS. 7, 7A and 7B, the beam 48 is still received in the receiving groove 35, and the ribs 482 are still received in the rib-receiving portions 352, respectively. However, the ribs 482 are close to the second edge surfaces 352S of the rib-receiving portions 352, respectively. Referring to FIG. 8, the bosses 452 are received in the regulation channels 344, respectively, and are located at the second ends 344S, respectively. Referring to FIGS. 7, 7A, 7B and 8, a further movement of the front insulator 40 along the attachment direction (negative Y-direction) is regulated by the second surface 322S of the side groove 322, the second edge surfaces 352S of the rib-receiving portions 352 and inner wall surfaces of the second ends 344S of the regulation channels 344.

Under the attached state, the lock portions 348 regulate movements of the locked portions 458 in the perpendicular direction (Y-direction), respectively, and the inner wall surfaces of the regulation channels 344 regulate forward movements of the bosses 452 in the front-rear direction (X-direction), respectively. In detail, when the front insulator 40 located at the second position is forced to be moved toward the first position along the positive Y-direction, the locked surfaces 458L of the locked portions 458 are brought into abutment with the lock surfaces 348L of the lock portions 348, respectively, so that the movement is stopped. When the front insulator 40 located at the second position is forced to be moved forward, the bosses 452 are brought into abutment with the front inner wall surfaces of the regulation channels 344, respectively, so that the movement is stopped.

As described above, the connector 10 according to the present embodiment is provided with a lock mechanism that locks into the attached state in which the front insulator 40 is attached to the base insulator 30. The lock mechanism locks into the attached state when the front insulator 40 is made to slide on the base insulator 30 from the first position to the second position along the perpendicular direction (Y-direction) to be attached to the base insulator 30.

The lock mechanism according to the present embodiment is formed of the two lock portions 348 and a plurality of the L-shaped channels 342 of the base insulator 30, and the two support portions 456, the two locked portions 458 and a plurality of the bosses 452 of the front insulator 40. Since the connector 10 according to the present embodiment is provided with the lock mechanism formed of these parts, the attached state can be securely maintained. In detail, the front insulator 40 located at the second position is hard to be moved even if it is pulled toward the first position and is hard to be detached even if it is pulled forward. In addition, the beam 48 received in the receiving groove 35 regulates the movement of the front insulator 40 in the upper-lower direction (Z-direction) to more securely maintain the attached state.

As described above, the connector 10 of the present embodiment is provided with the lock mechanism which securely locks into the attached state. However, the present invention is not limited thereto, but the structure of the lock mechanism can be variously modified. For example, each of the number of the lock portions 348 and the number of the locked portions 458 may be one or may be three or more. Each of the number of the L-shaped channels 342 and the number of the bosses 452 may be one. The lock mechanism may be formed of the lock portions 348 and the locked portions 458 having structures different from those of the present embodiment. Moreover, the connector 10 may be provided with no lock mechanism.

The front insulator 40 is exposed outward of the connector 10 in the upper-lower direction (Z-direction). Thus, the connector 10 is provided with no part that is brought into abutment with the support portion 456 upon resilient deformation of the support portion 456 which supports the locked portion 458. This structure prevents damage of the support portion 456. Moreover, each of the support portions 456 is a double-supported spring that has fixed opposite ends. This structure more reliably prevents the damage of the support portion 456.

As described above, the connector 10 of the present embodiment has various structures for preventing the damage of the support portion 456. However, the present invention is not limited thereto, but the damage of the support portion 456 can be prevented by some structure different from that of the present embodiment. Moreover, the structure for preventing the damage of the support portion 456 may be provided as necessary. For example, the front plate 42 of the front insulator 40 may cover the locked portions 458 and the support portions 456 from the front. Moreover, each of the support portions 456 may be a cantilever spring.

Referring to FIG. 8, the locked portions 458 are visible through the windows 424 when the connector 10 is seen from the front along the front-rear direction (X-direction). Thus, the locked portions 458 are exposed forward of the connector 10. In other words, the connector 10 is provided with no part that is brought into abutment with the locked portions 458 when the front insulator 40 is pulled forward under the attached state. In particular, the locked portions 458 and the support portions 456 are entirely visible through the notches 422 and the windows 424 when the connector 10 is seen from the front along the X-direction.

The aforementioned structure enables the front insulator 40 to be detached from the base insulator 30, for example, by using a jig (not shown). More specifically, the two locked portions 458 are moved outward in the upper-lower direction (Z-direction) by the jig inserted in the two notches 422 so that the attached state is unlocked. Then, the front insulator 40 is made to slide to the first position. The front insulator 40 that is moved to the first position can be pulled forward to be detached from the base insulator 30.

The present embodiment can be further variously modified in addition to the already described modifications.

Referring to FIGS. 7, 7A and 7B, the holding holes 330 according to the present embodiment are arranged in two rows, or in upper and lower rows. However; the present invention is not limited thereto, but the number of the rows of the holding holes 330 may be one or may be three or more. When the number of the rows of the holding holes 330 is one, the receiving groove 35 and the rib-receiving portions 352 do not need to be formed. However, when the beam 48 and the ribs 482 are provided to reinforce the front insulator 40, the base insulator 30 needs to be provided with some corresponding parts.

Figure 9:
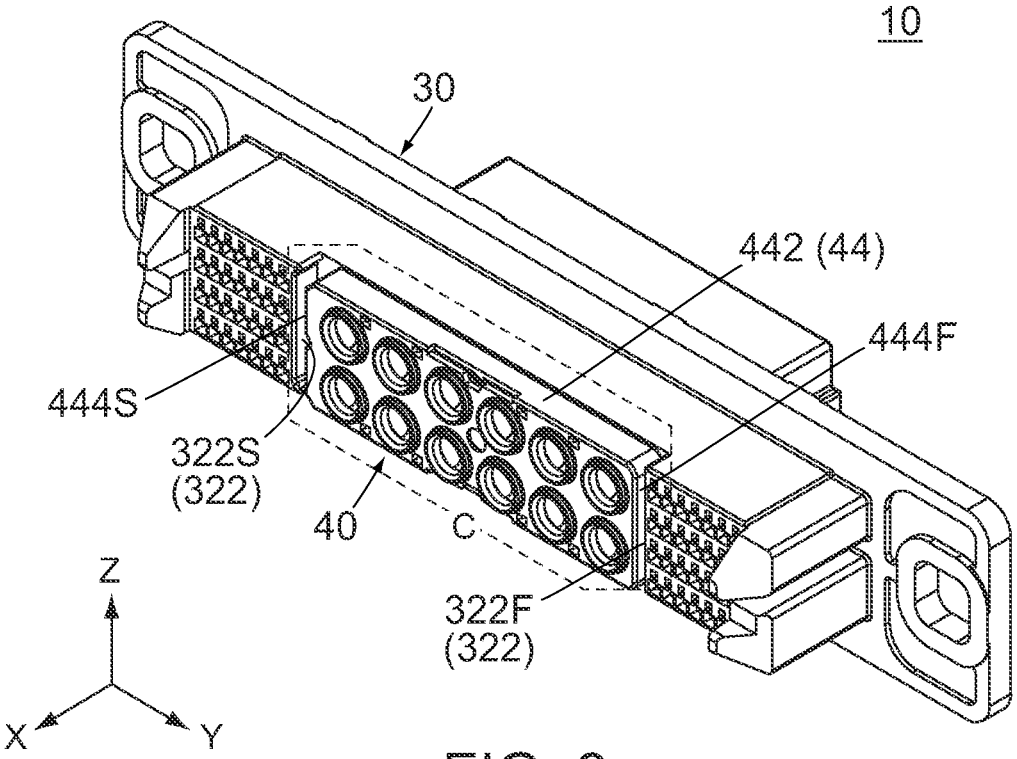
FIG. 9 is a perspective view showing the connector of FIG. 6, wherein the front insulator is located at a first position.

Referring to FIGS. 6 and 9, the attachment direction according to the present embodiment, or a movement direction of the front insulator 40 upon the attachment of the front insulator 40 to the base insulator 30, is the negative Y-direction. However the present invention is not limited thereto. The attachment direction only needs to be perpendicular to the front-rear direction (mating direction: X-direction). For example, the attachment direction may be the positive Y-direction. In this modification, the base insulator 30 and the front insulator 40 may be formed to have a structure which is mirror symmetric to that of the present embodiment with respect to the XZ-plane.

Referring to FIGS. 7, 7A, 7B, 8, 10, 10A and 10B, the movement of the front insulator 40 in the perpendicular direction (Y-direction) is regulated not only by the first surface 322F and the second surface 322S but also by the regulation channels 344 and the rib-receiving portions 352. Therefore, from a viewpoint of regulating the movement of the front insulator 40 in the perpendicular direction, one of or both of the first surface 322F and the second surface 322S do not need to be provided. For example, the base insulator 30 may have no parts that are located at opposite sides of the attachment portion 324 in the perpendicular direction. In other words, the side grooves 322 on opposite sides of the attachment portion 324 in the perpendicular direction do not need to be formed.

Referring to FIGS. 11 and 26, each of the mating terminals 72 is formed of a single metal plate to have a shape similar to that of the terminal 20 except for the mating contact portion 722 different from that of the terminal 20. Referring to FIGS. 15, 15A, 15B, 27 and 28, each of the mating holding holes 742 of the mating housing 74 has a structure similar to that of the holding hole 330 of the base insulator 30. Thus, the holding mechanism for the mating terminal 72 is basically identical to the holding mechanism for the terminal 20. Referring to FIG. 1, an electric shock prevention mechanism can be provided on the mating connector 70 instead of the connector 10. More specifically, the mating connector 70 may comprise a mating front insulator (not shown) similar to the front insulator 40.

The present application is based on a Japanese patent application of JP2017-137870 filed on Jul. 14, 2017 before the Japan Patent Office, the content of which is incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

REFERENCE SIGNS LIST

10 connector
20 terminal
22 cylindrical portion
24 receiving hole
250 contact portion
252 front hole
260 lance
262 rear hole
270 stopper
28 connection portion
30 base insulator
32 front portion
322 side groove
322F first surface
322S second surface
324 attachment portion
330 holding hole
332 inner wall
334 retaining portion
342 L-shaped channel
344 regulation channel
344F first end
344S second end
346 guide channel
348 lock portion
348R regulation surface
348S ramp
348L lock surface
35 receiving groove
352 rib-receiving portion
352F first edge surface
352S second edge surface
36 flange
362 fixed portion
38 rear portion
382 cable-receiving portion
384 cable-receiving hole
40 front insulator
42 front plate
422 notch
424 window
430 passing hole
432 guide portion
44 peripheral wall
442 attached wall
444F first coupling wall
444S second coupling wall
452 boss
456 support portion
458 locked portion
458L locked surface
458S ramp
48 beam
482 rib
70 mating connector
72 mating terminal
722 mating contact portion
74 mating housing
742 mating holding hole
82 cable
84 mating cable
86 case
862 panel

The invention claimed is:

1. A connector connectable to a cable, wherein:

the connector comprises a plurality of terminals, a base insulator and a front insulator;

each of the terminals has a cylindrical portion, a lance, a stopper and a connection portion;

the cylindrical portion has a cylindrical shape extending along a front-rear direction;

the lance extends rearward in the front-rear direction from the cylindrical portion while extending outward in a radial direction perpendicular to the front-rear direction;

the stopper projects outward in the radial direction from the cylindrical portion and is apart from the lance in the front-rear direction to be located rearward of the lance;

the connection portion is a part connected to the cable when the connector is used and is located rearward of the stopper in the front-rear direction;

the base insulator is formed with a plurality of holding holes corresponding to the terminals, respectively;

each of the terminals is held in a corresponding one of the holding holes;

each of the holding holes is formed with a gap which is located between an inner wall thereof and the cylindrical portion of a corresponding one of the terminals in a perpendicular plane perpendicular to the front-rear direction;

each of the holding holes is provided with a retaining portion located therewithin;

for each of the holding holes, the retaining portion is located between the lance and the stopper of the terminal in the front-rear direction;

the front insulator is formed with a plurality of passing holes corresponding to the terminals, respectively;

the front insulator is attached to the base insulator;

the passing holes are located in front of the holding holes in the front-rear direction, respectively;

each of the passing holes is smaller than the cylindrical portion of the corresponding one of the terminals in the perpendicular plane;

the connector is provided with a lock mechanism that locks into an attached state in which the front insulator is attached to the base insulator;

the lock mechanism locks into the attached state when the front insulator is made to slide on the base insulator along a perpendicular direction perpendicular to the front-rear direction to be attached to the base insulator; and under the attached state, no part of the front insulator is located in the holding holes of the base insulator.

2. The connector as recited in claim 1, wherein:

the base insulator has a fixed portion;

the base insulator is fixed to a panel of a case at the fixed portion when the connector is used; and when the base insulator is fixed to the panel, the front insulator is located outside the case.

3. The connector as recited in claim 1, wherein each of the terminals is held in the corresponding one of the holding holes of the base insulator to be rotatable.

4. A connector connectable to a cable, wherein:

the connector comprises a plurality of terminals, a base insulator and a front insulator;

each of the terminals has a cylindrical portion, a lance, a stopper and a connection portion;

the cylindrical portion has a cylindrical shape extending along a front-rear direction;

the lance extends rearward in the front-rear direction from the cylindrical portion while extending outward in a radial direction perpendicular to the front-rear direction;

the stopper projects outward in the radial direction from the cylindrical portion and is apart from the lance in the front-rear direction to be located rearward of the lance;

the connection portion is a part connected to the cable when the connector is used and is located rearward of the stopper in the front-rear direction;

the base insulator is formed with a plurality of holding holes corresponding to the terminals, respectively;

each of the terminals is held in a corresponding one of the holding holes;

each of the holding holes is formed with a gap which is located between an inner wall thereof and the cylindrical portion of a corresponding one of the terminals in a perpendicular plane perpendicular to the front-rear direction;

each of the holding holes is provided with a retaining portion located therewithin;

for each of the holding holes, the retaining portion is located between the lance and the stopper of the terminal in the front-rear direction;

the front insulator is formed with a plurality of passing holes corresponding to the terminals, respectively;

the front insulator is attached to the base insulator;

the passing holes are located in front of the holding holes in the front-rear direction, respectively;

each of the passing holes is smaller than the cylindrical portion of the corresponding one of the terminals in the perpendicular plane;

the base insulator has a plurality of L-shaped channels and a lock portion;

each of the L-shaped channels has a regulation channel and a guide channel;

in each of the L-shaped channels, the regulation channel extends in a perpendicular direction perpendicular to the front-rear direction;

in each of the L-shaped channels, the guide channel extends forward in the front-rear direction from an end of the regulation channel;

the front insulator has a plurality of bosses, a support portion and a locked portion;

the support portion is resiliently deformable;

the locked portion is supported by the support portion;

under an attached state in which the front insulator is attached to the base insulator, the bosses are received in the regulation channels of the L-shaped channels, respectively;

under the attached state, the lock portion regulates a movement of the locked portion in the perpendicular direction, and the regulation channels regulate forward movements of the bosses in the front-rear direction, respectively; and under the attached state, no part of the front insulator is located in the holding holes of the base insulator.

5. The connector as recited in claim 4, wherein the locked portion is visible when the connector is seen from the front along the front-rear direction.

6. The connector as recited in claim 5, wherein the locked portion and the support portion are entirely visible when the connector is seen from the front along the front-rear direction.

7. The connector as recited in claim 4, wherein:

the front insulator is exposed outward of the connector in an upper-lower direction perpendicular to both the front-rear direction and the perpendicular direction; and the support portion is a double-supported spring.

8. The connector as recited in claim 4, wherein:

the base insulator is formed with a receiving groove;

the receiving groove extends in the perpendicular direction;

the front insulator has a beam; and the beam extends in the perpendicular direction and is received in the receiving groove.

9. The connector as recited in claim 8, wherein:

the base insulator is formed with a rib-receiving portion;

the rib-receiving portion is connected to the receiving groove;

the beam of the front insulator is provided with a rib; and the rib extends in the front-rear direction and is received in the rib-receiving portion.

* * * * *